US007901857B2

(12) United States Patent
Nakazawa et al.

(10) Patent No.: US 7,901,857 B2
(45) Date of Patent: Mar. 8, 2011

(54) ELECTROSTATIC LATENT IMAGE DEVELOPING TONER, PRODUCTION METHOD THEREOF, ELECTROSTATIC LATENT IMAGE DEVELOPER, AND IMAGE FORMING METHOD

(75) Inventors: Hiroshi Nakazawa, Minamiashigara (JP); Takao Ishiyama, Minamiashigara (JP); Masanobu Ninomiya, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1080 days.

(21) Appl. No.: 11/181,934

(22) Filed: Jul. 15, 2005

(65) Prior Publication Data

US 2006/0210899 A1 Sep. 21, 2006

(30) Foreign Application Priority Data

Mar. 15, 2005 (JP) ..... 2005-074059

(51) Int. Cl.
*G03G 9/093* (2006.01)

(52) U.S. Cl. ..... 430/106.1; 430/110.2; 430/137.14; 430/123.52; 430/111.4

(58) Field of Classification Search ..... 430/106.1, 430/110.2, 123.53, 111.4, 33, 137.14
See application file for complete search history.

(56) References Cited

U.S. PATENT DOCUMENTS

| | | | | |
|---|---|---|---|---|
| 5,753,399 | A * | 5/1998 | Hayase et al. | 430/109.3 |
| 2004/0110078 | A1 * | 6/2004 | Teshima et al. | 430/110.2 |
| 2004/0191656 | A1 * | 9/2004 | Ishiyama et al. | 430/106.1 |
| 2004/0265729 | A1 * | 12/2004 | Patel | 430/137.14 |
| 2006/0210904 | A1 * | 9/2006 | Ninomiya et al. | 430/110.2 |

FOREIGN PATENT DOCUMENTS

| | | |
|---|---|---|
| JP | A-03-031857 | 2/1991 |
| JP | B2 4-30014 | 5/1992 |
| JP | A 10-123748 | 5/1998 |
| KR | 10 1991-0001471 A | 4/1994 |
| KR | 10-2001-0083034 A | 8/2001 |

* cited by examiner

*Primary Examiner* — Christopher RoDee
*Assistant Examiner* — Rachel L Zhang (Burney)
(74) *Attorney, Agent, or Firm* — Oliff & Berridge, PLC

(57) ABSTRACT

The present invention provides a toner for developing an electrostatic latent image comprising at least a core layer including at least a coloring agent and a first binder resin, and a shell layer for covering the core layer and including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less.

Moreover, a production method for the toner for developing an electrostatic latent image, a developer for developing an electrostatic latent image, using the toner, and an image forming method are provided.

17 Claims, No Drawings

ELECTROSTATIC LATENT IMAGE DEVELOPING TONER, PRODUCTION METHOD THEREOF, ELECTROSTATIC LATENT IMAGE DEVELOPER, AND IMAGE FORMING METHOD

CROSS-REFERENCE TO RELATED APPLICATION

This application claims priority under 35 USC 119 from Japanese Patent Application No. 2005-074059, the disclosure of which is incorporated by reference herein.

BACKGROUND OF THE INVENTION

1. Field of the Invention

The present invention relates to an electrostatic latent image developing toner used for developing an electrostatic latent image by the electrophotographic method, the electrostatic recording method, or the like, a production method thereof, an electrostatic latent image developer, and an image forming method.

2. Description of the Related Art

Methods for visualizing image information via a process of forming and developing an electrostatic latent image, such as the electrophotographic method, are currently utilized in various fields. Image formation by such methods is carried out by uniformly charging a photoreceptor surface, forming an electrostatic latent image by the exposure of the photoreceptor surface with a laser beam according to image information, then forming a toner image by developing the electrostatic latent image with a developer including a toner, and finally transferring and fixing the toner image onto a recording medium surface.

As a developer used in the electrophotographic method, a two-component developer made of a toner and a carrier, and a one-component developer using only a magnetic toner or a non magnetic toner are known. In general, a toner is produced by a kneading-pulverizing process, which consists of melt-compounding and cooling a thermoplastic resin with a pigment, a charge controlling agent and a releasing agent such as a wax, and then finely pulverizing and classifying. In order to improve the flowability and the cleaning property, the toner is used with inorganic particles or organic particles added to the surface of the toner particles.

In recent years, since images of higher image quality are demanded in the presentation of information documents created by various methods, increased image quality in various image forming methods has been much researched. Image forming methods utilizing the electrophotographic method are no exception in this regard. In the electrophotographic method in particular, a high function toner having a sharper particle size distribution with smaller diameter and the like is required in order to realize more high-definition images.

On the other hand, in recent years demand for energy saving has greatly increased also with respect to the electrophotographic method, and there is great demand for techniques to fix toner with reduced energy and toner that can be fixed at reduced temperature in order to reduce the amount of energy used in copying machines and toners. Conventionally, as a means for lowering the toner fixing temperature, a technique of lowering the glass transition temperature of the resin (binder resin) comprising the toner is generally known. However, by lowering the glass transition temperature, even though an excellent low temperature fixing property can be provided, aggregation (blocking) of the toner particles is easily generated, such that image quality defects such as white stripes, dropping, toner spilt stripes, or the like can be generated.

Therefore, in practical use, the lower limit value of the glass transition temperature of the binder resin used for a conventional toner is about 50° C. Additionally, the lowest fixing temperature in the case of using a toner using a binder resin having a 50° C. glass transition temperature is about 140° C., although this also depends on the kind of fixing machine. In such cases, a plasticizer can be used to further lower the lowest fixing temperature. However, in this case as in the case of lowering the glass transition temperature of the binder resin a problem arises in that the toner storage property deteriorates.

In order to solve these problems, a method for using a crystalline resin as the binder resin constituting the toner has long been known as a means for achieving both the blocking prevention and the low temperature fixing property (see, for example, Japanese Patent Application Publication (JP-B) Nos. 56-13943, 62-39428 and 63-25335). However, according to these techniques, since the melting point of the crystalline resin used is too low, there are problems in terms of the blocking property, insufficient fixing performance with respect to paper, and the like.

Therefore, for the purpose of improvement of the fixing property with respect to paper, a technique of using a crystalline polyester resin has been proposed. For example, a toner using a mixture of a non crystalline polyester resin and a crystalline polyester resin as the binder resin has been proposed (see JP-B No. 62-39428). However, according to technique, since the melting point of the crystalline polyester resin is high, the problem exists that a low temperature fixing property cannot be further improved on.

As a means of solving these problems, a technique of using a toner which is a mixture of a crystalline resin having a melting point of 110° C. or less and a non crystalline resin has been proposed (see JP-B No. 4-30014). However, in the case of mixing a non crystalline resin with a crystalline resin, the melting point of the toner is lowered and toner blocking generated, and thus the method is problematic in terms of practical use. Moreover, in the case that the ratio of the non crystalline resin component is high with respect to the crystalline resin component, since the characteristics of the non crystalline resin component are greatly reflected, it is difficult to provide a fixing temperature lower than that of the conventional toners. Additionally, since the glass transition temperature of the non crystalline resin is lowered, blocking property can deteriorate.

Furthermore, crystalline resins have low electric resistance due to the high degree of crystallization. Therefore, when an image is formed using a toner made of a crystalline resin, particularly in a high temperature high humidity environment, image defects such as injection superimposition and transfer failure are generated. Furthermore, since the toner is poor also in terms of bonding property with respect to paper, the strength of the image formed after fixation is also insufficient.

These problems cannot be improved even when a crystalline resin is used mixed with a non crystalline resin. That is, when the ratio of the crystalline resin in the binder resin used for the toner is high, even though the low temperature fixing property is excellent, the blocking resistance property, the image strength (bonding property with the paper) and the charging property (resistance) are poor. On the other hand, when the ratio of the non crystalline resin is high, even though the blocking resistance property, the image strength and the charging property (resistance) are improved, the low temperature fixing property, which is the most important property, is insufficient.

As mentioned above, a toner capable of realizing both a sufficient low temperature fixing property and storage property (blocking resistance property) has not been obtained.

On the other hand, with regard to the production method for a toner instead of the component materials of the toner as mentioned above, the toners commonly and widely used have conventionally been produced by the so-called kneading-pulverizing process (see, for example, Japanese Patent Application Laid-Open (JP-A) No. 51-23354). This production method obtains a toner by melt-compounding a mixture of a binder resin and a coloring agent produced by various methods, and, as needed, a releasing agent, a charge controlling agent, a magnetic material, or the like, mixed by a dry process, and then pulverizing and classifying.

When producing a toner having an excellent low temperature fixing property by the kneading-pulverizing process, a binder resin having a low glass transition temperature needs to be included. However, since a molten and kneaded product including such a binder resin cannot be pulverized due to the absence of brittleness, and furthermore, the binder resin can fuse and adhere to the various kinds of production equipment such as piping and collection devices used in the production thereof. Therefore, a toner having an excellent low temperature fixing property cannot be produced industrially by the kneading-pulverizing process. The same applies when using a crystalline resin as the binder resin in view of, for example, the decline of the yield due to the difficulty of pulverizing of the molten and kneaded product.

On the other hand, when a non crystalline resin is used in a combination with a crystalline resin as the binder resin with a larger ratio of the non crystalline resin, since the non crystalline resin forms a continuous phase in the molten and kneaded product, it can be pulverized. However, since the melting characteristics of a toner of such composition depend on the non crystalline resin, it is difficult to realize a low temperature fixing property.

As described above, according to the conventional kneading-pulverizing process, it has been difficult to obtain a toner capable of realizing low temperature fixation in view of production methods.

Nevertheless, recently, production methods for toners, using various kinds of polymerization processes, which are different from the kneading-pulverizing process, have been proposed. For example, a preparation method for a toner by a suspension polymerization process, a preparation method by a dispersion polymerization process (see JP-A Nos. 62-073276, 5-027476), and a preparation method by an emulsification polymerization aggregation process have been proposed.

Among these production methods, even though toner particle size distribution can be improved to some extent by the suspension polymerization process or the dispersion polymerization process, since the particle size distribution cannot be improved dramatically compared with a toner obtained by the kneading-pulverizing process, it is disadvantageous in that a classifying operation is required in most cases.

On the other hand, the emulsion-polymerization aggregation process provides a sharp particle size distribution, and furthermore, it enables of controlling the toner shape from a spherical to a potato shape. Therefore, recently in particular, such toner has come to be used as the preferred toner in image forming apparatuses with inexpensive high quality cleaning systems, with widespread commercial availability.

The emulsion-polymerization aggregation process is a method for producing a toner by producing a dispersion of resin particles by a polymerization process such as emulsion polymerization, and also producing a coloring agent dispersion with a coloring agent dispersed in a solvent, mixing the dispersions, forming aggregate particles by aggregation of the above-mentioned resin particles and coloring agent to a desired particle size by heating, controlling the pH, and/or adding a flocculating agent or the like, then growing the aggregate particles to a desired particle size, and finally, heating and fusing the aggregate particles at a temperature equal to or higher than the glass transition temperature of the resin particles.

The advantage of the new production methods is that the degree of freedom in controlling the toner structure is high, which was not been achieved by the kneading-pulverizing process.

For example, for a toner to be used for the oil-less fixation, a releasing agent such as a wax is included therein. Here, when the particle size of a toner obtained by the conventional kneading-pulverizing process is reduced to realize high image quality, flowability is seriously deteriorated such that black stripes, dropping pollution, or the like are generated by soft blocking, or the concentration cannot be controlled due to deterioration of the toner dispensability, which is problematic. This is because a large amount of wax tends to exist on the surface of the toner obtained, since pulverization of the kneaded and molten product takes place at the interface with the wax phase dispersed in a matrix.

On the other hand, with a toner obtained by the new production method, since a structure for encapsulating a releasing agent, that is, a core shell structure where a core layer including a releasing agent is covered with a shell layer made of a binder resin, can be realized, deterioration of flowability or the like is not generated.

Many attempts for obtaining a toner having a low temperature fixing property utilizing the new production methods have been proposed (see, for example, JP-A No. 10-123748). Specifically, a toner with a core shell structure using a binder resin having a low glass transition temperature suitable for low temperature fixation as the core layer binder resin, and a binder resin having a relatively high glass transition temperature as the binder resin comprising the shell layer for covering the core layer, has been proposed.

In the toner having the core shell structure, since binder resins of different kinds and physical properties can be used for the core layer and the shell layer, each layer can easily bear a specific function independently. By making the toner structure a core shell structure, an effect of distributing two or more functions required for the toner to the core layer and the shell layer separately can be obtained (hereinafter, also referred to as the "function distributing effect"); however, in a toner with a single layer structure produced by the conventional kneading-pulverizing process, the function distributing effect cannot be obtained.

Therefore, in a toner with a single layer structure produced by the conventional kneading-pulverizing process, even when two kinds of binder resins having different glass transition temperatures are used, since they are present in the toner in a compatible state, a low temperature fixing property and good toner storage property in a high temperature environment cannot be realized. However, a toner having the core shell structure can easily realize both the low temperature fixing property and storage property.

However, in order to realize energy saving, fixing at a temperature lower than the conventional configuration (an ultra low temperature fixing property) is required in a toner.

Moreover, since a process speed increase inevitably gives rise to substantial lowering of the fixing temperature, an ultra low temperature fixing property is also required in order to realize high speed. However, in a toner having the conventional core shell structure, even when simply the glass transition temperature of the binder resin material used for the core layer and the shell layer is reconsidered in order to secure a lower temperature fixing property, it has been difficult to realize both the ultra low temperature fixing property and sufficient storage property.

SUMMARY OF THE INVENTION

A first aspect of the present invention is to provide a toner for developing an electrostatic latent image comprising at least a core layer including at least a coloring agent and a first binder resin, and a shell layer for covering the core layer and including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less.

A second aspect of the invention is to provide a developer for developing an electrostatic latent image, using the toner according to the first aspect.

A third aspect of the invention is to provide a production method for the toner according to the first aspect comprising at least a core layer including at least a coloring agent and a first binder resin, and a shell layer for covering the core layer, including a second binder resin, comprising:

aggregating process of forming aggregate particles by adding an flocculating agent to a dispersion mixture of a first resin particle dispersion with first resin particles having a 1 μm or smaller of volume average particle size of the above-mentioned first binder resin dispersed and at least a coloring agent dispersion which is dispersed a coloring agent, and heating, adhering process of forming adhered resin aggregate particles by adding a second resin particle dispersion with second resin particles having a 1 μm or smaller volume average particle size of the above-mentioned second binder resin dispersed into the above-mentioned dispersion mixture with the above-mentioned aggregate particles formed for adhering the above-mentioned second resin particles on the surface of the above-mentioned aggregate particles, and fusing process of fusing the above-mentioned adhered resin aggregate particles to a temperature of or higher than the glass transition temperature of the above-mentioned second binder resin.

A fourth aspect of the invention is to provide an image forming method comprising charging process of charging the latent image bearing body surface, electrostatic latent image forming process of forming an electrostatic latent image by exposing the charged surface of the above-mentioned latent image bearing body according to the image information, developing process of forming a toner image by developing the above-mentioned electrostatic latent image with a developer including a toner, transfer process of transferring the above-mentioned toner image onto the recording medium surface, and fixing process of fixing the above-mentioned toner image transferred onto the above-mentioned recording medium surface by heating and pressurizing, wherein the above-mentioned toner is the toner according to the first aspect.

DETAILED DESCRIPTION OF THE INVENTION

In order to achieve the above-mentioned objects, the present inventors have elaborately discussed the reason why the ultra low temperature fixing property and the storage property can hardly be achieved at the same time according to a toner having the conventional core shell structure.

First, according to a toner having a core shell structure, as mentioned above, a binder resin included in the core layer has the function of ensuring the low temperature fixing property, and a binder resin included in the shell layer has the function of ensuring the storage property of the toner under the high temperature environment. Therefore theoretically, by reexamining the glass transition temperatures of the binder resins included in each layer, the lower temperature fixation can be achieved while ensuring the storage property. For example, in order to achieve the fixation at a lower temperature while ensuring the storage property to the same extent as the toner having the conventional core shell structure, it is considered that the glass transition temperature of the binder resin included in the core layer needs to be made lower.

However, according to the discussion of the inventors, it was confirmed that both of the ultra low temperature fixing property and the storage property can hardly be achieved at the same time by the simple approach as mentioned above. From this fact, the inventors have considered that the ultra low temperature fixing property and the storage property cannot be achieved at the same time only by paying attention to the glass transition temperatures of the binder resins used for the core layer and the shell layer.

On the other hand, in order to have the toner having the core shell structure pursue the performance as designed, it is necessary that the binder resin used for the core layer formation and the binder resin used for the shell layer formation should be present completely separately at the time of producing the toner, that is, the function distributing effect should be performed sufficiently. Moreover, according to the conventional toner having the single layer structure, the ultra low temperature fixing property and the storage property are the characteristics with the trade off relationship, that is, with the improvement of one of them gives rise to the deterioration of the other. Therefore, unless the two kinds of the binder resins are present in a sufficiently separate state in the toner, the ultra low temperature fixing property and the storage property cannot be both achieved at a high level.

Therefore, the inventors have considered that the difficulty of achieving both the ultra low temperature fixing property and the storage property in the toner having the conventional core shell structure owes to the compatibility to some extent of the binder resin to be included in the core layer and the binder resin to be included in the shell layer although it is not the complete compatible state as it is in the toner having the single layer structure. That is, in other words, it is considered that the function distributing effect, which is the characteristics inherent to the core shell structure is not sufficiently performed.

Moreover, even if a toner having the core shell structure, aiming at achieving both the ultra low temperature fixing property and the storage property, neglecting the compatible state generation, of course they can hardly be achieved at the same time, and furthermore, the charge maintenance property deterioration, the transfer maintenance property deterioration, or the like may be anticipated secondarily.

It is inevitable that the apparent glass transition temperature of the binder resin comprising the shell layer is lowered due to the compatibility of the binder resins with each other. Since a binder resin comprising the core layer needs to be one having a glass transition temperature lower than the conventional configuration, the degree of the decline of the apparent glass transition temperature of the binder resin comprising the shell layer is larger than that in the conventional configuration. Additionally, the degree of the apparent glass transition temperature increase of the binder resin comprising the core layer is larger than that in the conventional configuration. That is, the function distributing effect originally intended cannot be performed.

Therefore, as a result, it is difficult to achieve both the ultra low temperature fixing property and the storage property. In addition thereto, due to the external stress and the heat applied to the toner in the image forming apparatus, the embedment of the external additive to the inside of the toner becomes drastic so as to easily give rise to the charge maintenance property deterioration or the transfer maintenance property deterioration.

From the facts mentioned above, the inventors have considered that the ultra low temperature fixing property and the storage property can both be achieved if the function distributing effect, which is the characteristics inherent to the core shell structure, can be performed sufficiently by improving the compatible state of the binder resin to be included in the core layer and the binder resin to be included in the shell layer so as to find out the following inventions.

That is, the invention provides:

(1) A toner for developing an electrostatic latent image comprising at least a core layer including at least a coloring agent and a first binder resin, and a shell layer for covering the core layer, and including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less.

(2) The toner for developing an electrostatic latent image according to (1), wherein the difference between the above-mentioned temperature of one of the local maximum value and the above-mentioned temperature of the other local maximum value is 5° C. or more.

(3) The toner for developing an electrostatic latent image according to (1), wherein the glass transition temperature of the above-mentioned first binder resin is in a range of 25° C. or more and less than 50° C., and the glass transition temperature of the above-mentioned second binder resin is in a range of 50° C. or more and less 75° C. or less.

(4) The toner for developing an electrostatic latent image according to (1), wherein a releasing agent is included in the above-mentioned core layer.

(5) The toner for developing an electrostatic latent image according to (1), wherein magnetic metal particles having a 50 to 250 nm volume average particle size are used as the above-mentioned coloring agent.

(6) The toner for developing an electrostatic latent image according to (5), wherein the surface of the above-mentioned magnetic metal particles is covered with a covering layer, at least one kinds of the elements selected from the group consisting of Si, Ti, Ca, and P is included in the above-mentioned covering layer, and at least one kind of the polarized groups selected form the group consisting of a $SO_3^-$ group and a $COO^-$ group is included in the surface of the above-mentioned covering layer.

(7) The toner for developing an electrostatic latent image according to (1), wherein the volume average particle size is in a range of 5 to 9 μm.

(8) The toner for developing an electrostatic latent image according to (1), wherein the shape factor SF1 is in a range of 125 to 145.

(9) The toner for developing an electrostatic latent image according to (1), produced by at least:

an aggregating process of forming aggregate particles by adding an flocculating agent to a dispersion mixture of at least a first resin particle dispersion with first resin particles having a 1 μm or smaller volume average particle size of the above-mentioned first binder resin dispersed and a coloring agent dispersion with a coloring agent dispersed, and heating;

an adhering process of forming adhered resin aggregate particles by adding a second resin particle dispersion with second resin particles having a 1 μm or smaller volume average particle size of the above-mentioned second binder resin dispersed into the above-mentioned dispersion mixture with the above-mentioned aggregate particles formed for adhering the above-mentioned second resin particles on the surface of the above-mentioned aggregate particles; and a fusing process of fusing the above-mentioned adhered resin aggregate particles to a temperature of or higher than the glass transition temperature of the above-mentioned second binder resin.

(10) The toner for developing an electrostatic latent image according to (1), wherein the absolute value of the difference of the SP value of the above-mentioned first binder resin and the SP value of the above-mentioned second binder resin is in a range of 0.1 to 1.5.

(11) The toner for developing an electrostatic latent image according to (1), wherein an external additive having an average particle size in a range of 40 to 150 nm is added externally

(12) A developer for developing an electrostatic latent image, including a toner, wherein a toner for developing an electrostatic latent image comprising at least a core layer including at least a coloring agent and a first binder resin, and a shell layer for covering the core layer, including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less is used as the above-mentioned toner.

(13) A production method for a toner for developing an electrostatic latent image comprising at least a core layer including at least a coloring agent and a first binder resin, and a shell layer for covering the core layer, including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less is used as the above-mentioned toner, comprising:

an aggregating process of forming aggregate particles by adding an flocculating agent to a dispersion mixture of at least a first resin particle dispersion with first resin particles having a 1 μm or smaller volume average particle size of the above-mentioned first binder resin dispersed and a coloring agent dispersion with a coloring agent dispersed, and heating;

An adhering process of forming adhered resin aggregate particles by adding a second resin particle dispersion with second resin particles having a 1 μm or smaller volume average particle size of the above-mentioned second binder resin dispersed into the above-mentioned dispersion mixture with the above-mentioned aggregate particles formed for adhering the above-mentioned second resin particles on the surface of the above-mentioned aggregate particles; and a fusing process of fusing the above-mentioned adhered resin aggregate particles to a temperature of or higher than the glass transition temperature of the above-mentioned second binder resin.

(14) The production method for a toner for developing an electrostatic latent image according to (13), wherein a magnetic metal particle dispersion with magnetic metal particles having a 50 to 250 nm volume average particle size dispersed is used as the above-mentioned coloring agent dispersion.

(15) The production method for a toner for developing an electrostatic latent image according to (13), wherein a releasing agent dispersion with a releasing agent dispersed is included in the above-mentioned dispersion mixture to be used for the above-mentioned aggregating process.

(16) The production method for a toner for developing an electrostatic latent image according to (13), wherein the absolute value of the difference of the SP value of the above-mentioned first binder resin and the SP value of the above-mentioned second binder resin is in a range of 0.1 to 1.5.

(17) An image forming method comprising a charging process of charging the latent image bearing body surface, an electrostatic latent image forming process of forming an electrostatic latent image by exposing the charged surface of the above-mentioned latent image bearing body according to the image information, a developing process of forming a toner image by developing the above-mentioned electrostatic latent image with a developer including a toner, a transfer process of transferring the above-mentioned toner image onto the recording medium surface, and a fixing process of fixing the above-mentioned toner image transferred onto the above-mentioned recording medium surface by heating and pressurizing, wherein the above-mentioned toner is the toner according to the first aspect.

As explained above, according to the invention, a toner for developing an electrostatic latent image to be fixed at a temperature lower than the conventional configuration, having the excellent storage property, a production method thereof, a developer for developing an electrostatic latent image, and an image forming method can be provided.

<A Toner for Developing an Electrostatic Latent Image and Production Method Thereof>

A toner for developing an electrostatic latent image of the invention (hereinafter, it may be abbreviated as the "toner") comprises at least a core layer including at least a coloring agent and a first binder resin, and a shell layer for covering the core layer, and including a second binder resin, wherein two local maximum values of the tangent loss (tan δ) of the dynamic visco-elasticity are present in a temperature range of 90° C. or less, with one of the local maximum values present in a range of less than 60° C., and the other local maximum value present in a range of 60° C. or more and 90° C. or less.

Here, in the invention, the peaks confirmed as the local maximum values of the tangent loss in a range of 90° C. or less denote only those derived from the motion of the principal chain of the binder resin included in the toner, and thus those derived from the portions of the binder resin other than the principal chain are excluded.

In consideration to the physical properties of the binder resin used for the toner, particularly in a range of less than 30° C., it is considered only the peaks substantially not derived from the principal chain of the binder resin, but from the portions of the binder resin other than the principal chain are observed in most cases. Therefore, practically, two peaks of the tangent loss present in a temperature range of 30° C. or more and 90° C. or less are acceptable. Of course, as needed, a binder resin having a peak derived from the principal chain of the binder resin in a range of less than 30° C. may be used for the toner of the invention.

Therefore, in the case two peaks are present in a range of 90° C. or less, it denotes that two kinds of the binder resins are present independently in a non compatible state bilaterally in the toner, and in the case only one peak is present in a range of 90° C. or less, it denotes that two kinds of the binder resins are compatible bilaterally.

According to the toner of the invention, since two peaks are present in a range of 90° C. or less, the first binder resin included in the core layer (hereinafter, it may be abbreviated as the "binder resin for the core layer") and the second binder resin included in the shell layer (hereinafter, it may be abbreviated as the "binder resin for the shell layer") are present in the toner without being compatible with each other. Therefore, according to the toner of the invention, since the function distributing effect as the characteristics inherent to the core shell structure is performed sufficiently, the ultra low temperature fixing property and the storage property can both be achieved at a high level extremely easily.

On the other hand, according to a toner having the conventional core shell structure, since only one peak is present in a range of 90° C. or less, the function distributing effect cannot be performed sufficiently so that even in the case two kinds of the binder resins having dramatically different glass transition temperatures are used, it is difficult to achieve both the ultra low temperature fixing property and the storage property at a high level. That is, in the case a compatible state is generated, the glass transition temperature of the binder resin for the core layer is increased with respect to the designed value, and the glass transition temperature of the shell layer is lowered.

Moreover, since two kinds of the resins are present in a non compatible state, one of the peaks (hereinafter, it is referred to as the "first peak") is derived form the first binder resin, and the other peak (hereinafter, it is referred to as the "second peak") is derived from the second binder resin. Since the level of the temperature with the peak measurement has a close relationship with the level of the glass transition temperature, the temperature with the peak measurement can be dealt with as an index representing the melting characteristics of the toner.

Here, in order to ensure the ultra low temperature fixing property, the temperature with the first peak measurement needs to be present in a range of less than 60° C., the temperature is preferably 55° C. or less, and it is more preferably 50° C. or less. In the case the temperature with the first peak measurement is more than 60° C., fixation at a temperature lower than in the conventional configuration cannot be achieved. However, in view of the practical use such as the toner production property, or the like, the temperature with the first peak measurement is preferably 30° C. or more.

In the invention, although it depends also on the fixing system (the process speed and the pressure) to be used, the ultra low temperature fixation denotes the fixation to be carried out with the lowest fixing temperature in a range of about 90° C. to 130° C. in the case of using a two roll fixing machine of about a 160 mm/s process speed so that it denotes the fixation to be carried out by a fixing temperature lower than the lowest fixing temperature (fixing temperature=in a range of about 140° C. to 160° C.) realized in a toner having the conventional core shell structure by about 10° C. to 70° C.

Moreover, in order to ensure the storage property, the temperature with the second peak measurement needs to be present in a range of 60° C. or more, the temperature is preferably 65° C. or more, and it is more preferably 70° C. or more. In the case the temperature with the second peak measurement is less than 60° C., the shell layer is melted in the case the toner is left in a high temperature environment so as to deteriorate the storage property.

However, in view of ensuring the ultra low temperature fixing property, the temperature with the second peak measurement needs to be 90° C. or less. In the case it is more than 90° C., the shell layer is not melted at the time of the fixation so that the fixation itself cannot be carried out.

Moreover, the difference between the temperature with the first peak measurement and the temperature with the second peak measurement is preferably 5° C. or more, it is more preferably 8° C. or more, and it is further preferably 10° C. or more. In the case the difference between the temperatures with the two peak measurements is less than 5° C., since there is scarcely the difference between the melting characteristics of the two kinds of the binder resins, the ultra low temperature fixing property and the storage property may not be achieved at the same time.

In the invention, the tangent loss is calculated from the dynamic visco-elasticity measured by the sine wave vibration method. For the measurement of the dynamic visco-elasticity, the ARES measurement device (produced by Rheometric Scientific., Ltd.) is used.

Measurement of the dynamic visco-elasticity is carried out as follows. First, after forming a toner into tablet shape, it is set on a 8 mm diameter parallel plate. After setting the normal force at 0, a sine wave vibration is applied by a 6.28 rad/sec vibration frequency. Next, while raising the temperature by a 1° C./min from 20° C. to 100° C., it is measured by the measurement time interval of 30 seconds.

Before the measurement, the stress dependency of the distortion amount is confirmed from 20° C. to 100° C. by the 10° C. interval so as to find the distortion amount range with the stress and the distortion amount at each temperature having a linear relationship. Utilizing the result, the measurement of the dynamic visco-elasticity is carried out while maintaining the distortion amount at each measurement temperature in a range of 0.01% to 0.5% for controlling the stress and the distortion amount in a linear relationship in the all measurement temperature range.

In the case the glass transition temperature of the first binder resin used for the core layer is less than 25° C., further low temperature fixation can be realized. However, in the case of producing a toner by an emulsion-polymerization flocculation process suitable for the production of the toner of the invention to be described later, problems may be generated in terms of the production.

Specifically, in the case the reaction system temperature is higher than the glass transition temperature of the first binder resin in the stage of producing the resin particles or in the stage of producing the toner particles, aggregation of the resin emulsion particles with each other or adhesion or fixation to the toner production apparatus may easily be generated. Although cooling down the toner production apparatus, the piping, or the like for preventing the generation of the adhesion or fixation can be possible, but it requires too much cost and thus it is not realistic.

Moreover, even if the toner production apparatus, the piping, or the like are cooled down consuming a high cost, due to the aggregation of the particles of the first binder resin with each other may be too strong in the aggregating process, problems such as extreme deterioration of the dispersion of the other particle components (for example, the coloring agent particles and the releasing agent particles), and furthermore, in capability of taking the same into the aggregate particles (toner precursor) to be formed in the aggregating process, or the like may be generated.

On the other hand, in the case the glass transition temperature is 50° C. or more, the ultra low temperature fixing property may not be obtained.

Moreover, the glass transition temperature of the second binder resin to be used for the shell layer formation is preferably 50° C. or more and 75° C. or less, and it is more preferably 55° C. or more and 70° C. or less.

Thereby, favorable storage property can be obtained even under a high temperature environment. In the case the glass transition temperature is less than 50° C., the storage property may be deteriorated. Moreover, according to the miniaturization of the image forming apparatus nowadays, a process unit utilizing a toner may be disposed adjacent to a fixing machine having a heat generating source. According to the image forming apparatus, the inside temperature may be raised to about 50° C. In this case, if the toner storage property is poor, the toner may be adhered in the process unit or it may cause blocking so as to generate the image quality defect.

On the other hand, in the case the glass transition temperature is more than 75° C., the shell layer fusion may be insufficient in the case of carrying out the ultra low temperature fixation so that the fixation itself can be difficult.

Moreover, in the case of producing a toner of the invention utilizing the emulsion-polymerization flocculation process to be described later, the particles may not be fused and assembled sufficiently with each other in the fusing process so that the first binder resin component to be included in the core layer may be exposed to the surface. In such a case, a preferable storage property may not be obtained.

Next, the production method for a toner of the invention, the constituent materials, or the like will be explained. The production method for a toner of the invention is not particularly limited as long as it is a method capable of producing a toner having the so-called core shell structure having a core layer including a first binder resin and a coloring agent, and a shell layer for covering the core layer, including a second binder resin so that a known method can be utilized. In general, it is preferable to use a wet production method, in particular, the emulsion-polymerization aggregation process.

In this case, it is preferable that the toner of the invention is produced by at least an aggregating process of forming aggregate particles by adding a flocculating agent to a dispersion, which is prepared as mixture of at least a first resin particle dispersion with first resin particles having a 1 μm or smaller volume average particle size of the first binder resin dispersed and a coloring agent dispersion with a coloring agent dispersed, and heating, an adhering process of forming adhered resin aggregate particles by adding a second resin particle dispersion with second resin particles having a 1 μm or smaller volume average particle size of the second binder resin dispersed into the dispersion mixture with the aggregate particles formed for adhering the second resin particles on the surface of the aggregate particles, and a fusing process of fusing the adhered resin aggregate particles to a temperature of or higher than the glass transition temperature of the second binder resin.

Moreover, the toner of the invention includes the first binder resin and the coloring agent in the core layer, and the second binder resin in the shell layer. Additionally, as needed, various kinds of additives such as a releasing agent may be added internally, or various kinds of external additives such as a fluidizing auxiliary agent may be added externally. Moreover, in the case the toner of the invention is used as a one component developer, magnetic metal particles can be used as a coloring agent. In generally, the internal additive component such as a releasing agent is included in the core layer.

Hereinafter, the constituent materials of the toner of the invention and the physical properties thereof will be explained in further detail in consideration to the case of utilized for the emulsion-polymerization aggregation process mentioned above. Of course, the materials presented below may be utilized in the case of producing a toner of the invention by the other production methods.

—Binder Resin—

For a toner of the invention, two kinds of resins are used. First binder resin is used for the core layer formation and second binder resin is used for the shell layer formation. The absolute value (ΔSPcs) of the difference of the SP value (solubility parameter) of the first binder resin and the SP value of the second binder resin is preferably in a range of 0.1 to 1.5, and it is more preferably in a range of 0.2 to 1.0 herein.

In the case ΔSPcs is less than 0.1, compatibility of the first binder resin and the second binder resin is generated in the toner so that only one peak of the tangent loss may appear in a range of 90° C. or less of the toner to be obtained. In this case, since the function distributing effect as the characteristic inherent to the core shell structure may not be performed, the ultra low temperature fixing property and the storage property may hardly be achieved at the same time.

Moreover, in the case ΔSPcs is more than 1.5, at the time of producing a toner by the emulsion-polymerization aggregation process, the particles of the second binder resin comprising the shell layer may hardly be adhered evenly onto the aggregate particle surface to form the core layer finally.

Therefore, at the time of producing the toner of the invention, it is preferable to utilize the first binder resin and the second binder resin in a combination so as to satisfy the ΔSPcs value as explained above.

Moreover, in the case the toner of the invention includes a releasing agent in the core layer, the absolute value (ΔSPrs) of the difference of the SP value of the releasing agent and the SP value of the binder resins (both of the first binder resin and second binder resin) is preferably in a range of 1.0 to 2.5, and it is more preferably in a range of 1.2 to 2.2. Thereby, at the time of producing a toner by the emulsion-polymerization aggregation process, the releasing agent can be taken into the toner without the need of using a flocculating agent or a surfactant by a large amount, and furthermore, compatibility with the second binder resin to form the shell layer can be prevented.

In the case ΔSPrs is less than 1.0, since the second binder resin and the releasing agent are compatible so that the glass transition temperature of the shell layer is lower than the designed value, the storage property may be deteriorated. Moreover, in the case ΔSPrs is more than 2.5, due to the extreme poorness of the affinity with the first binder resin, the releasing agent may hardly be encapsulated in the toner. Additionally, in the case a toner is produced using a large amount of the flocculating agent or the surfactant in order to solve the problem, coarse powders may be generated or the particle size distribution may easily be widened so that a preferable image quality may not be obtained.

There are various methods for calculating the SP value (solubility parameter), such as the Small method and the Fedors method. Fedors method was used for calculating the solubility parameter herein.

The SP value in this case is defined by the following equation (1):

$$SP = \sqrt{\frac{\Delta E}{V}} = \sqrt{\frac{\sum_i \Delta ei}{\sum_i \Delta vi}} \quad \text{Equation (1)}$$

In the equation (1), SP represents the solubility parameter, ΔE represents the aggregation energy (cal/mol), V represents the mole volume ($cm^3$/mol), Δei represents the evaporation energy of the i-th atom or atomic group (cal/atom or atomic group), Δvi represents the mole volume of the i-th atom or atomic group ($cm^3$/atom or atomic group), and i represents an integer of 1 or more.

The SP value represented by the equation (1) is calculated so as to have [$cal^{1/2}/cm^{3/2}$] as its unit by practice, and it is represented by no dimension. Additionally, in the invention, since the relative difference of the SP values between the two compounds is meaningful, a value calculated according to the above-mentioned practice is used and represented by no dimension.

For reference, in the case the SP value represented by the equation (1) is converted to the SI unit [$J^{1/2}/m^{3/2}$], the value is multiplied by 2046.

—First Binder Resin (Binder Resin for the Core Layer)—

As the first binder resin used in the invention, a known non crystalline or crystalline resin may be utilized. In the case it is a non crystalline resin, specifically, the following materials can be utilized.

That is, as the non crystalline resin, polymers of a monomer of styrenes such as a styrene, a parachlorostyrene and an α-methyl styrene; esters having a vinyl group, such as a methyl acrylate, an ethyl acrylate, an n-propyl acrylate, a lauryl acrylate, a 2-ethyl hexyl acrylate, a methyl methacrylate, an ethyl methacrylate, an n-propyl methacrylate, a lauryl methacrylate and a 2-ethyl hexyl methacrylate; vinyl nitrites such as an acrylonitrile and a methacrylonitrile; vinyl ethers such as a vinyl methyl ether and a vinyl isobutyl ether; vinyl ketones such as a vinyl methyl ketone, a vinyl ethyl ketone and a vinyl isopropenyl ketone; polyolefins such as an ethylene, propylene and a butadiene, a copolymer as a combination of two or more kinds of the monomers, or a mixture of these polymers or the copolymers can be presented.

Furthermore, the above-mentioned resins, non vinyl condensation resins such as epoxy resins, polyester resins, polyurethane resins, polyamide resins, cellulose resins and polyether resins, or a mixture of thereof and a vinyl based resin synthesized using the above-mentioned vinyl based monomer, a grafted polymer obtained by the polymerization of a vinyl based monomer under the co-presence of them, or the like can be presented. These resins may be used alone by one kind or in a combination of two or more kinds.

Among these resins, in the case a vinyl based monomer is used, a resin particle dispersion can be produced by executing the emulsion polymerization or the seed polymerization using an ionic surfactant, or the like. In the case another resin is used, a desired resin particle dispersion can be produced by dissolving the resin in an oil based solvent having a relatively low dissolubility with respect to water, dispersing the particles in water by a dispersing machine such as a homogenizer under the co-presence of an ionic surfactant or a polymer electrolyte, and thereafter evaporating the solvent by heating or reducing the pressure.

The above-mentioned thermoplastic binder resin can be produced stably as particles obtained by the emulsion polymerization, or the like by including a dissociable vinyl based monomer.

Examples of the dissociable vinyl based monomers include an acrylic acid, a methacrylic acid, a maleic acid, a cinnamic acid, a fumaric acid, a vinyl sulfonic acid, an ethylene imine, a vinyl pyridine, a vinyl amine, or the like so that a monomer to be the raw material of a polymer acid, or a polymer base can either be used. For the polymer shaping reaction easiness, or the like, a polymer acid is preferable. Furthermore, a dissociable vinyl based monomer having a carboxyl group such as an acrylic acid, a methacrylic acid, a maleic acid, a cinnamic acid and a fumaric acid is particularly effective for the polymerization degree control and the glass transition point control.

Next, an example of the case of using a non crystalline polyester resin as the binder resin for the core layer will be explained hereinafter, but the invention is not limited thereto.

A polyester resin is synthesized from a polyvaleic carboxylic acid component and a polyhydric alcohol component. In the invention, as the polyester resin, a commercially available product may be used, or one optionally synthesized may be used as well.

As the polyhydric alcohol component, for example, as the dihydric alcohol component, an ethylene glycol, a propylene glycol, a 1,4-buthane diol, a 2,3-butane diol, a diethylene glycol, a triethylene glycol, a 1,5-pentane diol, a 1,6-hexane diol, a neopentyl glycol, a 1,4-cyclohexane dimethanol, a dipropylene glycol, a polyethylene glycol, a polypropylene glycol, a bisphenol A, a hydrogenated bisphenol A, or the like can be used. Moreover, as trihydric or higher alcohol component, a glycerol, a sorbitol, a 1,4-sorbitane, a trimethylol propane, or the like can be used.

Moreover, as the divaleic carboxylic acid component to be condensed with the above-mentioned polyhydric alcohol component, for example, a maleic acid, a maleic anhydride, a fumaric acid, a phthalic acid, a terephthalic acid, an isophthalic acid, a malonic acid, a succinic acid, a glutaric acid, a dodecenyl succinic acid, an n-octyl succinic acid and a lower alkyl ester of these acids can be used.

As the polyvaleic carboxylic acid component, for example, aliphatic dicarboxylic acids such as an oxalic acid, a succinic acid, a glutaric acid, an adipic acid, a suberic acid, an azelaic acid, a sebacic acid, a 1,9-nonane dicaroxylic acid, a 1,10-decane dicarboxylic acid, a 1,12-dodecane dicarboxylic acid, a 1,14-tetradecane dicarboxylic acid and a 1,18-octadecane dicarboxylic acid, dibasic acids such as a phthalic acid, an isophthalic acid, a terephthalic acid, a naphthalene-2,6-dicarboxylic acid, a malonic acid and a mesaconic acid, or the like can be presented. Furthermore, an anhydride thereof and a lower alkyl ester thereof can be presented, but it is not limited thereto.

As the trivaleic or higher carboxylic acid, for example, a 1,2,4-benzene tricarboxylic acid, a 1,2,5-benzene tricarboxylic acid, a 1,2,4-naphthalene tricarboxylic acid, an anhydride thereof, a lower alkyl ester thereof, or the like can be presented. They can be used alone by one kind or in a combination of two or more kinds.

Moreover, as the acid component, in addition to the aliphatic dicarboxylic acids and the aromatic dicarboxylic acids mentioned above, it is preferable that a dicarboxylic acid component having a sulfonic acid group is included. The above-mentioned dicarboxylic acid having a sulfonic acid group is effective in terms of preferably dispersing the colorant such as a pigment. Moreover, at the time of producing a binder resin particle dispersion by emulsifying or suspending the entire resin in water, if the dicarboxylic acid component has a sulfonic acid group, emulsification or suspension can be carried out without using a surfactant as it will be described later.

On the other hand, the dispersion including the resin particle made of the first binder resin used for the toner production can be obtained by dispersing the resin in a water based medium such as water together with a polymer electrolyte such as an ionic surfactant, a polymer acid and a polymer base, heating the same to a temperature of the resin melting point or higher, and processing with a homogenizer or a pressure discharge type dispersing machine capable of applying a strong shearing force. The binder resin for the core layer can be used as a mixture of a plurality of kinds of the resins.

The volume average particle size of the resin particles of the first binder resin is preferably 1 μm or less, and more preferably it is in a range of 0.02 to 0.5 μm. If the volume average particle size of the resin particles is more than 1 μm, the particle size distribution or the shape distribution of the toner to be finally obtained can be wide, or free particles can be generated so as to cause uneven distribution of the toner composition so that deterioration of the performance or the reliability can be brought about.

On the other hand, if the volume average particle size of the resin particles is in the above-mentioned range, not only the above-mentioned shortcomings are not brought about, the uneven distribution in the toner can be reduced so that the dispersion in the toner can be improved, so as to reduce the irregularity of the performance and the reliability, and thus it is advantageous. The volume average particle size of the resin particles can be measured using for example a micro track, or the like.

—Second Binder Resin (Binder Resin for the Shell Layer)—

Next, as the binder resin for the shell layer used in the invention, the same materials described for the above-mentioned binder resins for the core layer can be used. However, as mentioned above, it is preferable to select the binder resin for the shell layer according to the binder resin for the core layer to be used such that the ΔSPcs value is in a range of 0.1 to 1.5.

The dispersion including the resin particles of the second binder resin used for the toner production can be produced in the same manner as in the case of the first binder resin. Here, the volume average particle size of the resin particles of the second binder resin is preferably 1 μm or less, and more preferably it is in a range of 0.02 to 0.3 μm.

In the case the volume average particle size of the resin particles of the second binder resin is more than 1 μm, the particle size distribution or the shape distribution of the toner to be obtained finally can be wide, or free particles can be generated so as to cause uneven distribution of the toner composition so that deterioration of the performance or the reliability can be brought about.

On the other hand, if the volume average particle size of the resin particles is in the above-mentioned range, not only the above-mentioned shortcomings are not brought about, since the shell can be formed evenly on the toner surface by a small shell amount, and thus it is more preferable.

As to the combination of the first binder resin and the second binder resin to be used for the toner production, in order to perform the function distributing effect, in addition to pay attention to the ΔSPcs value, it is preferable to use non crystalline polyester resins in a combination as the first and second binder resins in terms of improvement of the document storage property.

The reason thereof is that a polyester resin is superior in terms of the brittleness at the glass transition temperature compared with a vinyl based resin so as to enable the low molecular amount design, and thus the glass transition temperature design for obtaining the same fixing temperature can be made higher than that of the vinyl based resin by about 10 to 15° C.

That is, since the low viscosity releasing agent is eluted due to the deformation at the time of the fixation so that even though a state with the fixed image surface covered with the low viscosity releasing agent but not completely, the image storage property after the fixation depends on the glass transition temperature of the binder resin in the toner. Therefore, the polyester resin capable of making higher the glass transition temperature of the core layer has the superior document storage property. Furthermore, since it is superior in terms of the brittleness at the binder resin on the shell layer side, a low molecular weight can be enabled so as to make lower the melting viscosity, and thus the ultra low temperature fixation is not hindered. For these reasons, in the case the non crystalline polyester resins are used in a combination for both the core layer and the shell layer, not only the ultra low temperature fixation is enabled so as to obtain the excellent toner storage property, but also the further superior image storage property (document storage property) can be obtained.

—Coloring Agent—

As a coloring agent used in the invention, a known coloring agent can be used. For example, various kinds of pigments such as a carbon black, a chromium yellow, a hanza yellow, a benzidine yellow, an indanthrene yellow, a quinoline yellow, a permanent yellow, a permanent orange GTR, a pyrazolone orange, a Vulcan orange, a Watchung red, a permanent red, a brilliant carmine 3B, a Brilliant carmine 6B, a daybon oil red, a pyrazolone red, a resol red, a rhodamine B lake, lake red C, rose Bengal, an aniline blue, a ultra marine blue, a chalcoyl blue, a methylene blue chloride, a phthalocyanine blue, a phthalocyanine green and a malachite green oxalate, various kinds of dyes such as an acrydine based one, a xanthene based one, an azo based one, a benzoquinone based one, an azine based one, an anthraquinone based one, a lyoindigo based one, a dioxazine based one, a thiazine based one, an azomethine based one, an indigo based one, a lyoindigo based one, a phthalocyanine based one, a triphenyl methane based one, a diphenyl methane based one, a reazine based one, a riazol based one and a xanthene based one, or the like can be used by one kind or in a combination of two or more kinds.

For the production of a coloring agent dispersion to be used at the time of producing a toner, a known dispersion method can be utilized. For example, a common dispersing means such as a rotating shearing type homogenizer, a ball mill having a medium, a sand mill, a dynomill and an ultimizer can be adopted without any limitation. The coloring agent is dispersed in water together with a polymer electrolyte such as an ionic surfactant, a polymer acid, and a polymer base. The volume average particle size of the dispersed coloring agent particles may be 1 μm or less. If it is in a range of 80 to 500 nm, the coloring agent can be dispersed preferably in the toner without deteriorating the aggregating property, and thus it is preferable.

—Magnetic Metal Particles—

In the case the toner of the invention is used as a toner for a one component developer, it is preferable to use magnetic metal particles as the coloring agent.

For the magnetic metal particles, known substances to be magnetized in a magnetic field can be used, and thus ferromagnetic powders of an iron, a cobalt, a nickel, or the like, and particles of a compound such as a ferrite and a magnetite can be utilized. As to the production of a magnetic metal particle dispersion used at the time of producing the toner, it can be produced by dispersing in the same manner as in the case of the above-mentioned coloring agent dispersion.

Moreover, the volume average particle size of the magnetic metal particles is preferably 50 nm to 250 nm in terms of the encapsulating property into the toner. If the volume average particle size is less than 50 nm, they may be aggregated again after the dispersion process so that coarse particles having a large particle size may be formed as a result so as to deteriorate the encapsulating property. Moreover, in order to restrain the re-aggregation, a large amount of a dispersing agent is required. In this case, the charge deterioration may be brought about.

On the other hand, if the volume average particle size is larger than 250 nm, since the dispersion controllability at the time of forming the toner is lowered so as to hinder the optional control, disturb the encapsulation of the magnetic metal particles, and furthermore, have the magnetic metal particles present alone in the dispersion mixture easily, they may be adhered on the toner surface as a result so as to cause the charge performance deterioration. In the case a toner of the invention is produced by the emulsion-polymerization aggregation process, since the toner is obtained in the water phase, attention should be paid to the mobility into water phase, the solubility and the oxidizing property of the magnetic metal particles. Therefore, at the production of the toner, it is preferable to use magnetic metal particles with the surface improvement such as the hydrophobic process preliminarily applied.

Since the magnetic metal particles have their surface easily oxidized or reduced, the surface characteristics can drastically be changed by these reactions. Therefore, in the case a toner is produced by a wet production method such as the emulsion-polymerization aggregation process, using the magnetic metal particles with the surface deterioration caused, the toner charging property is deteriorated.

For example, in an acidic environment, the magnetic metal particle surface can be oxidized so as to have the color tone change to reddish brown, or in an alkaline environment, in the case the magnetic metal particles include an iron, iron hydroxide particles are produced so as to generate the magnetic property change.

Moreover, in an acidic environment, metal ions produced by dissolution of the magnetic metal particle metal are present in a water based medium. Therefore, according to the emulsion-polymerization aggregation process, due to collapse of the ion balance of the aggregation system, the aggregation speed control can be difficult, or according to the suspension polymerization process, the polymerization disturbance can be generated. In this case, control of the particle size can particularly be difficult. Furthermore, according to the dissolution suspension granulating process or the emulsion-polymerization flocculation process, a problem is involved in that the particles can hardly be stabilized at the time of granulation or emulsification.

From these viewpoints, it is preferable that the solubility of the magnetic metal particles to a 50° C., 1 mol/l $HNO_3$ aqueous solution is 500 mg/g·l or less. In the case the solubility is more than 500 mg/g·l due to collapse of the ion balance at the time of forming the toner particles, not only the stability of the magnetic metal particles is lowered but also it can easily be oxidized, and as a result, a sufficient blackness cannot be obtained.

For reducing the solubility, an ordinary surface process technique for the magnetic metal particles can be used. For example, in the case a magnetic ferrite, a magnetite, or a black titanium oxide is used, it is preferable to apply acid resistance, alkaline resistance process.

For example, surface coverage with a coupling material, surface coverage with gold, platinum, carbon deposition, or the like, or surface coverage with a sodium polyacrylate, a potassium polymethacrylate, or a styrene-acrylic acid copolymer can be applied. The covering thickness is preferably 10 to 200 nm by the weight average film thickness. In the case it is less than 10 nm, due to uneven coverage, the covering effect is poor so that the acid resistance and the alkaline resistance are poor, and thus the elution or the decomposition may not be prevented. Moreover, in the case it is more than 500 nm, not only the particle size distribution of the magnetic metal particles with the covering process is wide but also it is economically disadvantageous.

Furthermore, in order to stabilize the dispersion property of the magnetic metal particles in a water based medium, it is preferable that a polarized group such as a $COO^-$ group and a $SO_3^-$ group is included in the surface of the covering layer for covering the surface of the magnetic metal particles. Therefore, it is preferable that a compound including such a polarized group, such as an sodium alkyl benzene sulfonate or a mixture including the same, a sodium acrylate, a sodium methacrylate and a potassium methacrylate is included in the covering layer in a range of 0.01 to 3% by mass.

In the case the content of the compound including the polarized group in the covering layer is less than 0.01% by mass, due to the poor dispersion effect of the magnetic metal particles, the encapsulating property of the magnetic metal particles in the toner may not be obtained sufficiently, or the magnetic metal particles may easily be aggregated again in the dispersion with the magnetic metal particles dispersed after the dispersion process.

Moreover, in the case the content of the compound including the polarized group in the covering layer is more than 3% by mass, the time for sufficiently removing is too long at the time of the washing process of the toner particles finally obtained, and thus it may be economically disadvantageous.

On the other hand, a toner used for a one component developer involves a problem peculiar thereto of the image lack generation at the time of bending the paper due to weakening of the image intensity, in particular, the bending strength. The reason therefore is that the toner used for the one component developer has a weaker penetrating property of the toner into the paper at the time of fixation, derived from the amount of the magnetic powders encapsulated in the toner compared with the case of a two component developer not including the magnetic powders.

However, in the case a polarized group such as a $COO^-$ group and a $SO_3^-$ group is included in the surface of the covering layer, owing to the preferable dispersion property of the magnetic metal particles in the toner, the content of the magnetic metal particles to be encapsulated in the toner can further be made smaller. Therefore, by improving the penetration property of the toner to the paper can be improved at the time of fixation so that the image intensity can be improved as a result.

Moreover, it is preferable that one or more kinds of the elements selected from the group consisting of Si, Ti, Ca and P is included in the covering layer in terms of the oxidization prevention of the magnetic metal particles and the toner charging. That is, since exposure of the magnetic metal particle surface can be restrained as much as possible by applying the process represented by the coupling process including these elements, or the like, discoloration of the magnetic metal particles, and furthermore, the influence on the dielectric loss by the conduction path blockage at the time of providing the toner can be reduced, and thus it is preferable also from the viewpoint of the color image quality, transfer, or the like.

Although the shape of the magnetic metal particles is not particularly limited, a sphere, an octahedron, a rectangular parallelepiped, or the like can be presented, and magnetic metal particles of different shapes may be used as a mixture. Furthermore, the magnetic metal particles can be used together with a colorant such as a carbon black. Since the fine powders can easily be taken into the aggregate particles in the aggregating process according to the use of the carbon black, the particle size distribution of the toner to be obtained finally can be made sharper.

—Releasing Agent—

For a toner of the invention, as needed, a releasing agent can be used. As the releasing agent, those known can be used. Examples thereof include low molecular weight polyolefins such as a polyethylene, a polypropylene, and a polybutene, silicones having a softening point by heating, aliphatic amides such as an amide oleate, an amide erucate, an amide ricinolate, and an amide stearate, plant based waxes such as a carnauba wax, a rice wax, a candelira wax, a wood wax and a jojoba oil, animal based waxes such as a honey wax, ore, petroleum based waxes such as a montan wax, an ozokerite, a ceresin, a paraffin wax, a micro crystalline wax, a Fischer-Tropsch wax, synthetic waxes and modified products thereof.

Among these known releasing agents, in particular, by using a paraffin wax having the melting point in a range of 75 to 100° C., the effect of improving the fixing characteristics, specifically, the offset in a high temperature range can be remarkable.

Moreover, among the paraffin waxes, in particular, by using a Fischer-Tropsch wax having the melting point in a range of 75 to 100° C., the offset property in a high temperature range can be preferable in an image forming apparatus of any processing speed from the low speed range to the high speed range. Additionally, in the case the cleaning means used for the image forming apparatus is a cleaning blade, the excellent blade cleaning suitability can be provided.

In the case a wax other than the paraffin wax or the Fischer-Tropsch wax is used as the releasing agent, all the range from the low speed range to the high speed range may not be satisfied as in the case the high speed process speed suitability cannot be provided even though the low speed process speed suitability is provided.

Moreover, in the case the melting point is lower than 75° C., the image defects such as the low concentration due to the toner dispensing property decline accompanied by the deterioration of the toner storage property and the flowability, and the trimmer part clogs (white stripes) due to the toner solidification. On the other hand, in the case the melting point is more than 100° C., since the releasing agent can hardly be eluted efficiently between the toner image and the fixing member surface at the time of fixation, the offset may be generated at a high temperature.

The content of the releasing agent in the toner is preferably 5 to 20% by mass, and more preferably it is 7 to 13% by mass. In the case it is less than 5% by mass, the offset may be generated at a high temperature. In the case it is more than 20% by mass, due to the extreme deterioration of the taking property of the releasing agent into the inside of the toner, even though the toner structure is provided as a core shell structure, the toner flowability is deteriorated due to the presence of the free releasing agent or the releasing agent adhered on the toner surface, or the like.

For the production of the releasing agent dispersion, it can be obtained by dispersing a releasing agent in water together with a polymer electrolyte such as an ionic surfactant, a polymer acid or a polymer base, heating the same to a temperature of the releasing agent melting point or higher, and applying the dispersion process with a homogenizer or a pressure discharge type dispersing machine capable of applying a strong shearing force. Thereby, a releasing agent dispersion including the releasing agent particles having a 1 μm or less volume average particle size can be obtained. The volume average particle size of the releasing agent particles is more preferably 100 to 500 nm.

In the case the volume average particle size is less than 100 nm, although it also depends on the characteristics of the binder resin to be used, in general the releasing agent component can hardly be taken into the toner. Moreover, in the case it is more than 500 nm, the dispersion state of the releasing agent in the toner may be insufficient. In the aggregating process, the releasing agent dispersion may be added and mixed at one time together with the various dispersions such as the resin particle dispersion, or they may be added separately by multiple stages.

—Flocculating Agent—

Next, the flocculating agent, the dispersing medium, the surfactant, or the like, as the secondary components to be used at the time of producing the toner of the invention by the emulsion-polymerization aggregation process will be explained.

As the flocculating agent, in addition to a surfactant having the opposite polarity with respect to the surfactant used for the resin particle dispersion or the coloring agent dispersion, a divaleic or higher inorganic metal salt can be used preferably. In particular, in the case an inorganic metal salt is used, the use amount of the surfactant can be reduced and the toner charging characteristics can be improved, and thus it is preferable.

As the inorganic metal salt, for example, metal salts such as a calcium chloride, a calcium nitrate, a barium chloride, a magnesium chloride, a zinc chloride, an aluminum chloride and an aluminum sulfate, inorganic metal salt polymers such as a polyaluminumchloride, a polyaluminumhydroxide, and a polycalciumsulfate, or the like can be presented. Among these examples, in particular, an aluminum salt and a polymer thereof are preferable. In order to obtain a sharper particle size distribution, as to the valeic number of the inorganic metal salt, divaleic is more preferable than monovaleic, trivaleic to divaleic and tetravaleic to trivaleic, and for the same valeic number, a polymerizable type inorganic metal salt polymer is more preferable.

The addition amount of the flocculating agent is preferably about 0.05 to 1.00% by mass with respect to the solid component (toner component) of the dispersion mixture although it depends on the ion concentration at the time of the aggregation, and it is more preferably 0.10 to 0.50% by mass. In the case it is less than 0.05% by mass, the flocculating agent effect can hardly appear, and in the case it is more than 1.00% by mass, due to the excessive aggregation, a toner having a large particle size can easily be generated so that the image defect derived from the transfer failure may be generated. Furthermore, the strong aggregation in the apparatus may be generated, and thus it may not be preferable in terms of the production.

—Dispersing Medium—

As the dispersing medium used for the production of various kinds of the dispersions, for example, a water based medium can be presented. As the above-mentioned water based medium, for example, water such as distilled water and ion exchange water, alcohols, or the like can be presented. They can be used alone by one kind or in a combination of two or more kinds.

—Surfactant—

In the invention, it is preferable that a surfactant is added and mixed in the various kinds of the dispersions. As the above-mentioned surfactants, for example, anionic surfactants such as an ester sulfate based one, a sulfonate based one, an ester phosphate based one and a soap based one; cationic surfactants such as an amine salt type and a tertiary ammonium salt type; nonionic surfactants such as a polyethylene glycol based one, an alkyl phenol ethylene oxide adduct based one and a polyhydric alcohol based one, or the like can be presented preferably. Among these examples, the ionic surfactants are preferable, and the anionic surfactants and the cationic surfactants are more preferable.

It is preferable that the above-mentioned nonionic surfactants are used in a combination with the above-mentioned anionic surfactants or the cationic surfactants. The above-mentioned surfactants may be used alone by one kind or in a combination of two or more kinds.

As the specific examples of the above-mentioned anionic surfactants, fatty soaps such as a potassium laurate, a sodium oleate and a sodium castor oil; ester sulfates such as an octyl sulfate, a lauryl sulfate, a lauryl ether sulfate, and a nonyl phenyl ether sulfate; sulfonic acid salts such as sodium alkyl naphthalene sulfonates such as lauryl sulfonate, a dodecyl sulfonate, a dodecyl benzene sulfonate, a triisopropyl naphthalene sulfonate and a dibutyl naphthalene sulfonate, a naphthalene sulfonate formalin condensation product, an amido lauric acid sulfonate, and an amido oleic acid sulfonate; ester phosphates such as a lauryl phosphate, an isopropyl phosphate, and a nonyl phenyl ether phosphate; sulfosuccinates such as a monooctyl sulfosuccinate, a dioctyl sulfosuccinate, sodium dialkyl sulfosuccinate such as sodium dioctyl sulfosuccinate, a 2 sodium lauryl sulfosuccinate, and a 2 sodium lauryl polyoxy ethylene sulfosuccinate; or the like can be presented.

As the specific examples of the above-mentioned cationic surfactants, amine salts such as a lauryl amine hydrochloride, a stearyl amine hydrochloride, an oleyl amine acetate, a stearyl amine acetate and a stearyl aminopropyl amine acetate; quarternary ammonium salts, such as a lauryl trimethyl ammonium chloride, a dilauryl dimethyl ammonium chloride, a distearyl ammonium chloride, a distearyl dimethyl ammonium chloride, a distearyl dimethyl ammonium chloride, a lauryl dihydroxy ethyl methyl ammonium chloride, an oleyl bispolyoxyethylene methyl ammonium chloride, a lauroylaminopropyl dimethyl ethyl ammonium ethosulfate, a lauroyl amino propyl dimethyl hydroxylethyl ammonium perchlorate, an alkyl benzene dimethyl ammonium chloride, and an alkyl trimethyl ammonium chloride; or the like can be presented.

As the specific examples of the above-mentioned nonionic surfactants, alkyl ethers such as a polyoxyethylene octyl ether, a polyoxyethylene lauryl ether, a polyoxyethylene stearyl ether and a polyoxyethylene oleyl ether; alkyl phenyl ethers such as a polyoxyethylene octyl phenyl ether and a polyoxyethylene nonyl phenyl ether; alkyl esters such as a polyoxyethylene laurate, a polyoxyethylene stearate and a polyoxyethylene oleate; alkyl amines such as a polyoxyethylene lauryl amino ether, a polyoxyethylene stearyl amino ether, a polyoxyethylene oleyl amino ether, a polyoxyethylene soy amino ether and a polyoxyethylene beef tallow amino ether; alkyl amides such as a polyoxyethylene lauric amide, a polyoxyethylene stearic amide, and a polyoxyethylene oleic amide; plant oil ethers such as a polyoxyethylene castor oil ether, and a polyoxyethylene rapeseed oil ether; alkanol amides such as a diethanol lauric amide, a diethanol stearic amide, and a diethanol oleate amide; sorbitan ester ethers such as a polyoxyethylene sorbitan monolaurate, a polyoxyethylene sorbitan monopalmitate, a polyoxyethylene sorbitan monostearate, and a polyoxyethylene sorbitan monooleate; or the like can be presented.

—Emulsion-Polymerization Aggregation Process—

Next, the production process for a toner by the emulsion-polymerization aggregation process including the aggregating process, the adhering process and the fusing process already described will be explained for each process successively.

First, a dispersion mixture is prepared by mixing various kinds of dispersions to be used for the aggregating process by a predetermined ratio. Here, as the dispersions, at least a first resin particle dispersion and a coloring agent dispersion are used, and as needed, a releasing agent dispersion may be mixed therein.

In the case of mixing the three kinds of the dispersions, the content of the resin particles with respect to the total solid component included in the dispersion mixture may be 40% by mass or less, and it is preferably about 2 to 20% by mass. Moreover, the content of the coloring agent particles may be 50% by mass or less, and it is preferably about 2 to 40% by mass. Furthermore, the content of the releasing agent particles may be 50% by mass or less, and it is preferably about 5 to 40% by mass. In the case a magnetic metal particle dispersion with magnetic metal particles dispersed is used instead of the coloring agent dispersion, the content of the magnetic metal particles may be 50% by mass or less, and it is preferably about 2 to 40% by mass.

Furthermore, in the case the components (particles) other than those mentioned above are used, the content may be of the extent not to hinder the achievement of both the ultra low temperature fixing property and the storage property. That is, the content is, in general, an extreme small amount, specifically, it is about 0.01 to 5% by mass by the solid component, and it is preferably about 0.5 to 2% by mass.

The method for preparing the various kinds of the dispersions is not particularly limited, and a method selected optionally according to the purpose may be adopted. The dispersing means is not particularly limited. As the usable devices, known dispersing devices, for example, Homomixer (Tokushu Kika Kogyo Co., LTD), Slusher (Mitsui Mining Co., LTD), Cavitron (Eurotech, LTD), Micro Fluidizer (Mizuho Industrial Co., LTD), Manton-Gorin Homogenizer (Gorin Corp.), Nanomizer (Nanomizer Corp.), Static Mixer (Noritake Company), or the like, can be presented.

—Aggregating Process—

In the aggregating process, first, aggregate particles with the particles of each component are formed by adding an flocculating agent to a dispersion mixture obtained by mixing the first binder resin dispersion, the coloring agent dispersion, and furthermore, the releasing agent dispersion and the other components to be used as needed, and heating at in vicinity of a glass transition temperature of the first binder resin. In the case of producing a toner for a one component developer, a magnetic metal particle dispersion with magnetic metal particles dispersed may be used as the coloring agent dispersion.

The aggregate particles can be formed by adding an flocculating agent at a room temperature while agitating with a rotating shearing type homogenizer. As the flocculating agent used in the aggregating process, surfactants of the polarity opposite to that of the surfactant used as the dispersing agent of the dispersions, the above-mentioned inorganic metal salts, and the divaleic metal complexes or of a higher divaleic number can be used preferably.

In particular, in the case a metal complex is used, the use amount of the surfactant can be reduced and the charge characteristics can be improved, and thus it is particularly preferable.

—Adhering Process—

In the adhering process, a covering layer is formed by adhering the resin particles of the second binder resin onto the aggregate particles including the first binder resin formed by the above-mentioned aggregating process (hereinafter, the aggregate particles provided with the covering layer on the aggregate particle surface will be referred to as the "adhered resin aggregate particles"). Here, the covering layer corresponds to the shell layer of the toner of the invention to be formed by the fusing process to be described later.

The covering layer can be formed by adding the second resin particle dispersion into the dispersion with the aggregate particles formed in the aggregating process, and as needed, the other components such as the flocculating agent may be added at the same time.

By forming the covering layer by evenly adhering the above-mentioned adhered resin aggregate particles on the surface of the above-mentioned aggregate particles, and heating and fusing the above-mentioned adhered resin aggregate particles in the fusing process to be described later, the resin particles of the second binder resin included in the covering layer on the surface of the aggregate particles are melted so as to form a shell layer. Therefore, exposure of the releasing agent included in the core layer disposed inside the shell layer or the components having a glass transition temperature lower than that of the second binder resin, such as the first binder resin to the surface of the toner can be prevented effectively.

The method for adding and mixing the second binder particle dispersion in the adhering process is not particularly limited. For example, it may be carried out by gradually and continuously, or it may be divided into a plurality of stages. By adding and mixing the second binder resin particle dispersion accordingly, generation of the minute particles can be restrained so that the particle size distribution of the toner to be obtained can be made sharper.

The number of executing the adhering process in the invention may either be one time or a plurality of times.

The conditions at the time of adhering the resin particles of the second binder resin onto the above-mentioned aggregate particles are as follows. That is, the heating temperature in the adhering process is preferably in the vicinity of the glass transition temperature of the first binder resin included in the aggregate particles to the vicinity of the glass transition temperature of the second binder resin. Specifically, the lower limit value of the heating temperature range in this case is preferably in a range of −5° C. to +10° C. with respect to the first binder resin glass transition temperature, and the upper limit value of the heating temperature range is preferably in a range of −10° C. to +10° C. with respect to the second binder resin glass transition temperature.

In the case the heating operation is carried out at a low temperature lower than the first binder resin glass transition temperature by more than −5° C., the resin particles of the first binder resin present on the aggregate particle surface and the resin particles of the second binder resin adhered on the aggregate particle surface can hardly be adhered, and as a result the thickness of the shell layer to be formed may be uneven.

Additionally, since the resin particles of the second binder resin incapable of adhering to the aggregate particles are present independently in the system, clogs are generated in the case of separating the solid and the liquid by a filter press, or the like, and furthermore, they are present as ultra fine powders independently at the time of providing a toner, the carrier pollution, or the like can easily be generated particularly in the case of a two component developer.

Moreover, in the case the heating operation is carried out at a high temperature higher than the second binder resin glass transition temperature by more than +10° C., the resin particles of the first binder resin present on the aggregate particle surface and the resin particles of the second binder resin adhered on the aggregate particle surface can easily be adhered.

However, due to the excessive adhering property, adhesion of the adhered resin aggregate particles with each other is also generated so as to deteriorate the particle size distribution of the toner to be obtained. Furthermore, due to the presence of a large number of the adhered aggregate particles not including the coloring agent or the releasing agent to be added as needed, the image defects such as micro white dots may be generated.

Since the heating time in the adhering process depends on the heating temperature, thus it cannot be limited collectively, however, it is in general about 5 minutes to 2 hours.

In the adhering process, the dispersion with the second resin particle dispersion added to the dispersion mixture with the aggregate particles formed may be placed still or agitated moderately with a mixer, or the like. Since the even adhered resin aggregate particles can be formed easily in the latter case, and thus it is advantageous.

Although the use amount of the second resin particle dispersion in the adhering process depends on the particle size of the resin particles included therein, it is selected preferably to have the thickness of the shell layer to be formed finally of about 20 to 500 nm. The use amount of the second binder resin based on the solid component is preferably 1 to 40% by mass of the toner total amount, and it is more preferably 5 to 30% by mass.

In the case the thickness of the shell layer is less than 20 nm, the storage property may not be obtained preferably. Moreover, in the case the thickness of the shell layer is more than 500 nm, the ultra low temperature fixing property may be hindered.

—Fusing Process—

In the fusing process, the adhered resin aggregate particles obtained in the adhering process are fused by heating. The fusing process can be carried out at the glass transition temperature of the second binder resin or higher. As to the fusing time, with a high heating temperature, a short time is sufficient, and with a low heating temperature, a long time is needed. That is, since the fusing time depends on the heating temperature and thus it cannot be limited collectively, it is in general 30 minutes to 10 hours.

In the fusing process, the cross-linking reaction may be carried out simultaneously with the heating operation, or the cross-linking reaction may be carried out after finishing the fusing operation.

—Washing/Drying Process—

For the fused particles obtained by the fusing process, solid-liquid separation such as filtration, washing and drying are carried out. Thereby, a toner without addition of an external additive can be obtained.

In this case, in order to ensure the sufficient charge characteristics and reliability as a toner, it is preferably to wash the same sufficiently. In the washing process, a remarkable washing effect can be obtained by processing with an acid such as a nitric acid, a sulfuric acid and a hydrochloric acid or an alkaline solution represented by a sodium hydroxide, and washing with ion exchange water, or the like. In the drying process, an optional method can be adopted, such as an ordinary vibration type fluidizing drying method, a spray dry method, a freezing and drying method and a flash jet method. It is preferable to adjust the moisture content of the toner particles after drying to 2% by mass or less, and more preferably 1% by mass or less.

—External Additive and Internal Additive—

To the obtained toner particles, an inorganic oxide represented by a silica, a titania and an aluminum oxide may be added and adhered for the purpose of adjusting the charge, providing the flowability, providing the charge exchangeability, or the like. This can be carried out with, for example, a V type blender, a Henschel mixer, a Redige mixer, or the like for the adhesion in several stages.

As the inorganic particles, for example, a silica, an alumina, a titanium oxide, a barium titanate, a magnesium titanate, a calcium titanate, a strontium titanate, a zinc oxide, quartz sand, clay, mica, wollastonite, diatomaceous earth, a cerium chloride, a red iron oxide, a chromium oxide, cerium oxide, an antimony trioxide, a magnesium oxide, a zirconium oxide, a silicon carbonate, a silicon nitride, or the like can be presented. Among these examples, silica particles are preferable, and in particular silica particles with the hydrophobic treatment are preferable.

The above-mentioned inorganic particles are used in general for the purpose of improving the flowability. Among the above-mentioned inorganic particles, a methatitanic acid $TiO(OH)_2$ is capable of providing a developer having the good charging property, environment stability, flowability, caking resistance, stable negative charging property, and stable image quality maintaining property without influencing the transparency. Moreover, it is preferable that the hydrophobic treated compound of a methatitanic acid has a $10^{10}$ Ω·cm or more electric resistance for obtaining a high transfer property without generation of the toner charged to the opposite polarity even in the case the transfer electric field is raised at the time it is processed to the colored particles so as to be used as a toner. The volume average particle size of the external additive for the purpose of providing the flowability is preferably in a range of 1 to 40 nm as the primary particle size, and it is more preferably in a range of 5 to 20 nm. Moreover, the volume average particle size of the external additive for the purpose of improving the transfer property is preferably in a range of 50 to 500 nm. It is preferable to execute the surface improvement such as the hydrophobic treatment to the external additive particles in terms of stabilizing the charging property and the developing property.

As the means for improving the above-mentioned surface improvement, conventionally known methods can be used. Specifically, a coupling treated with a silane, a titanate, an aluminate, or the like can be presented. The coupling agent to be used for the coupling treatment is not particularly limited. For example, silane coupling agents such as a methyl trimethoxy silane, a phenyl trimethoxy silane, a methyl phenyl dimethoxy silane, a diphenyl dimethoxy silane, a vinyl trimethoxy silane, a γ-amino propyl trimethoxy silane, a γ-chloro propyl trimethoxy silane, a γ-bromo propyl trimethoxy silane, a γ-glycidoxy propyl trimethoxy silane, a γ-mercapto propyl trimethoxy silane, a γ-ureido propyl trimethoxy silane, a fluoro alkyl trimethoxy silane and a hexamethyl disilazane; titanate coupling agents; aluminate coupling agents; or the like can be presented as the preferable examples.

Furthermore, various kinds of additives may be added as needed. These additives include other fluidizing agents, cleaning auxiliary agents such as polystyrene particles, polymethyl methacrylate particles, polyvinylidene fluoride particles, abrasive agents for the purpose of removing the photoreceptor adhered product such as a zinc stearyl amide, a strontium titanate, or the like.

The addition amount of the above-mentioned external additives is preferably in a range of 0.1 to 5 parts by weight with respect to 100 parts by weight of the toner in a state without the addition of the external additive, and it is more preferably in a range of 0.3 to 2 parts by weight. In the case the addition amount is less than 0.1 part by mass, the toner flowability may not be obtained sufficiently, and furthermore, the problems such as incapability of sufficiently providing the charge, deterioration of the charge exchange property, or the like are brought about, and thus it is not preferable. On the other hand, in the case the addition amount is more than 5 parts by weight, it would cause the excessively covered state so that the excessive inorganic oxide may move to the contact member so as to cause the secondary trouble.

Furthermore, as needed, the coarse particles of the toner may be removed after the external addition using a ultrasonic sieve machine, a vibration sieve machine, a wind power sieve machine, or the like.

Moreover, in addition to the above-mentioned external agents, the other components (particles) such as an internal additive, a charge controlling agent, organic particles, a lubricating agent, and an abrasive agent may be added.

The internal additives include a metal or an alloy of a ferrite, a magnetite, a reduced iron, a cobalt, a manganese, and a nickel, or a magnetic substance such as a compound including these metals, or the like. They can be used by an amount to the extent not to hinder the charge property as the toner characteristics.

The charge controlling agent is not particularly limited. Particularly in the case a color toner is used, colorless one or a hypochromic color one can be used preferably. For example, a quarternary ammonium salt compound, a nigrosin based compound, a dye of a complex of an aluminum, an iron, a chromium, or the like, a triphenyl methane based pigment, or the like can be presented.

The organic particles include all the particles to be used ordinarily as an external additive for the toner surface such as a vinyl based resin, a polyester resin and a silicone resin. These inorganic particles or organic particles can be used as a flowability auxiliary agent, a cleaning auxiliary agent, or the like.

The lubricating agent include an aliphatic amide such as an ethylene bisstearic amide and an oleic amide, aliphatic metal salts such as a zinc stearate and a calcium stearate, or the like.

The abrasive agents include the above-mentioned alumina, cerium oxide, or the like.

Furthermore, in the invention, for the purpose of improving the toner storage property, it is preferable to externally add particles of a 40 to 150 nm volume average particle size onto the toner particle surface. With particles having a less than 40 nm volume average particle size, the storage property may not be improved sufficiently. With particles of more than 150 nm, due to incapability of firmly adhering onto the toner surface, they can easily drop off from the toner particle surface so as to cause the carrier pollution, flaw the photoreceptor surface, or generate the filming.

The specific examples of the external additives to be used for the purpose of the improvement of the storage property include particles of inorganic oxides such as a silica, a titania, a zinc oxide, a strontium oxide, an aluminum oxide, a calcium oxide, a magnesium oxide, a cerium oxide, and a composite oxide thereof, and organic particles of a vinyl based resin, a polyester resin and a silicone resin.

Among these examples, a silica and a titania can be used preferably in terms of the particle size, the particle size distribution and the productivity. In particular, silica particles having a spherical shape and produced utilizing the sol gel process are preferable.

Although the addition amount of the external additives with respect to the toner is not particularly limited, and it can be used preferably in a range of 0.1 to 10% by mass, and more preferably in a range of about 0.3 to 5% by mass.

In the case the addition amount is less than 0.1% by mass, the addition effect may not be obtained sufficiently. Moreover, in the case it is more than 10% by mass, due to the increase of the external additive dropped off from the toner particle surface, adhesion to the photoreceptor, that is, so-called filming may be generated, or the photoreceptor surface may be flawed.

It is preferable to apply the surface improvement such as the hydrophobic treatment to these external additives in terms of stabilizing the charge property and the developing property. As the means for the surface improvement, the conventionally known methods can be used. Specifically, the above-mentioned coupling treated with the silane, the titanate or the aluminate can be presented.

Next, the preferable characteristics in terms of the form, such as the shape and the particle size of the toner of the invention will be explained.

As to the particle size distribution index of the toner of the invention, it is preferable that the volume average particle size distribution index GSDv is 1.30 or less. Moreover, it is preferable that the ratio of the volume average particle size distribution index GSDv and the number average particle size distribution index GSDp (GSDp/GSDv) is 0.95 or more.

In the case the volume average particle size distribution index GSDv is 1.30 or less, since the components both on the fine powder side and the coarse powder side are reduced in the toner particle size distribution, a preferable state can be maintained in terms of the developing property, the transfer property and the cleaning property. Moreover, in the case GSDp/GSDv is 0.95 or more, a toner having the particularly sharp charge distribution can be obtained so that the excellent developing property and transfer property can be provided so as to obtain an image with a high image quality.

Moreover, it is preferable that the volume average particle size of the toner of the invention is in a range of 5 to 9 μm. In the case the volume average particle size is less than 5 μm, not only a desired image density cannot be obtained but also fogging in the background part and pollution in the apparatus by toner scattering can easily be generated. On the other hand, in the case it is more than 9 μm, a highly sophisticated image may not be obtained.

Furthermore, it is preferable that the shape factor SF1 of the toner of the invention is in a range of 125 to 145. In the case the shape factor SF1 is less than 125, the cleaning failure may be generated, and in the case it is more than 145, the transfer efficiency may be deteriorated.

The surface area of the toner of the invention is not particularly limited, and it may be in a range to be used for an ordinary toner. Specifically, in the case of using the BET method, it is in a range of 0.5 to 10 $m^2/g$, it is preferably in a range of 1.0 to 7 $m^2/g$, it is more preferably in a range of about 1.2 to 5 $m^2/g$. It is further preferably in a range of about 1.2 to 3 $m^2/g$.

<Developer for Developing the Electrostatic Latent Image>

The developer for developing the electrostatic latent image of the invention (hereinafter it may be abbreviated as the "developer") is not particularly limited as long as it contains a toner of the invention, and it may either be a one component developer using a toner alone or a two component developer including a toner and a carrier. In the case of a one component developer, a toner including magnetic metal particles is used.

For example, the carrier in the case of using the carrier is not particularly limited, and known carriers can be presented. For example, known carriers such as the resin covered carriers disclosed in the official gazettes of the JP-A Nos. 62-39879, 56-11461, or the like can be presented.

The specific examples of the carrier include the following resin covered carriers. As the core particles for the carrier, ordinary iron powders, ferrite, magnetite granulates, or the like can be presented. The volume average particle size thereof is in a range of about 30 to 200 μm.

Moreover, as the covering resin for the above-mentioned resin covering carrier, homopolymers or copolymers comprising a monomer of, for example, styrenes such as a styrene, a parachlorostyrene and an α-methyl styrene; α-methylene fatty acid monocarboxylic acids, such as a methyl acrylate, an ethyl acrylate, an n-propyl acrylate, a lauryl acrylate, a 2-ethyl hexyl acrylate, a methyl methacrylate, an n-propyl methacrylate, a lauryl methacrylate and a 2-ethyl hexyl methacrylate; nitrogen containing acrylics such as a dimethyl amino ethyl methacrylate; vinyl nitriles such as an acrylonitrile and a methacrylonitrile; vinyl pyridines such as a 2-vinyl pyridine and a 4-vinyl pyridine; vinyl ethers such as a vinyl methyl ether and a vinyl isobutyl ether; vinyl ketones such as a vinyl methyl ketone, a vinyl ethyl ketone and a vinyl isopropenyl ketone; olefins such as an ethylene and a propylene; vinyl based fluorine containing monomers such as a vinylidene fluoride, a tetrafluoro ethylene, and a hexafluoro ethylene; or the like, and furthermore, silicone resins including a methyl silicone, a methyl phenyl silicone, or the like, polyesters containing a bisphenol, a glycol, or the like, epoxy resins, polyurethane resins, polyamide resins, cellulose resins, polyether resins, polycarbonate resins, or the like can be presented. These resins may be used alone by one kind or in a combination of two or more kinds. The covering amount of the covering resin is preferably in a range of about 0.1 to 10 parts by weight with respect to 100 parts by weight of the above-mentioned core member particles, and it is more preferably in a range of 0.5 to 3.0 parts by weight.

For the production of the carrier, a heating type kneader, a heating type Henschel mixer, a UM mixer, or the like can be used. Depending on the amount of the above-mentioned covering resin, a heating type fluidized rotating bed, a heating type kiln, or the like can be used.

The mixing ratio of the above-mentioned toner for developing the electrostatic latent image of the invention and the carrier in an electrostatic latent image developer is not particularly limited, and it can be selected optionally according to the purpose.

<Image Forming Method and Image Forming Apparatus>

Next, the image forming method and the image forming apparatus using the toner of the invention will be explained. The toner of the invention can be used for the image forming method utilizing the known electrophotographic method. Specifically, it can be utilized in the image forming method having the following processes.

That is, it is preferably an image forming method comprising a charging process of charging the latent image bearing body surface, an electrostatic latent image forming process of forming an electrostatic latent image by exposing the charged surface of the latent image bearing body according to the image information, a developing process of forming a toner image by developing the electrostatic latent image with a developer including a toner, a transfer process of transferring the toner image onto the recording medium surface, and a fixing process of fixing the toner image transferred onto the recording medium surface by heating and pressurizing. In addition thereto, other processes may be provided. For example, it is preferable to have a cleaning process of cleaning the residual toner on the surface of the latent image bearing body after the transfer of the toner image. Moreover, in the transfer process, an intermediate transfer member for mediating the transfer of the toner image from the latent image bearing body to the recording medium may be used.

Moreover, as the image forming apparatus, an image forming apparatus utilizing the above-mentioned image forming method may be used. Specifically, an image forming apparatus comprising at least a latent image bearing body, a charging means for charging the latent image bearing body surface, an electrostatic latent image forming means (exposing means) for forming an electrostatic latent image by exposing the charged surface of the latent image bearing body according to the image information, a developing means for forming a toner image by developing the electrostatic latent image with a developer including a toner, a transfer means for transferring the toner image onto the recording medium surface, and a fixing means for fixing the toner image transferred onto the recording medium surface by heating and pressurizing can be presented. In addition thereto, known means such as a cleaning means such as a cleaning blade, for cleaning the residual toner on the surface of the latent image bearing body after the transfer of the toner image, or an intermediate transfer means (intermediate transfer member) for mediating the transfer of the toner image from the latent image bearing body to the recording medium may be provided. Moreover, in the case of forming a color image, an image forming apparatus comprising a plurality of latent image bearing bodies corresponding to the toners of each color, that is, of the so-called tandem type may be employed.

Since the toner of the invention allows the ultra low temperature fixation, the energy consumption amount at the time of forming an image can be restrained further than the conventional configuration.

EXAMPLES

Hereinafter, the invention will be explained in detail with reference to the examples, but the invention is not limited thereto.

<Method for Measuring Various Particles>

First, method for measuring and evaluating various kinds of particles such as a toner used in the examples and the comparative examples mentioned below will be explained.

(Method for Measuring the Particle Size of the Binder Resin Particles, Coloring Agent Particles and the Releasing Agent Particles)

The particle size of the binder resin particles, the coloring agent particles and the releasing agent particles is measured by a laser diffraction type particle size distribution measuring device (LA-700, produced by Horiba Seisakusho Corp.).

(Method for Measuring the Particle Size, and the Particle Size Distribution of the Toner, or the Like)

For the particle size and the particle size distribution index, a Coulter counter TA 11 (produced by Beckman Coulter, Inc.) is used, and as the electrolyte, ISOTON-II (produced by Beckman Coulter, Inc.) is used.

As to the measuring method, a dispersing agent is produced by adding 0.5 to 50 mg of a measuring specimen into 2 ml of a surfactant, preferably, a 5% aqueous solution of an alkyl benzene sodium sulfonate. This is added to 100 to 150 ml of the above-mentioned electrolyte.

A dispersing process is applied to the electrolyte with the specimen suspended for about 1 minute with a ultrasonic dispersing device. With the above-mentioned Coulter counter type TA-II, the particle size distribution of 2 to 60 μm particles are measured using a 10 μm aperture as the aperture size so as to find the volume average distribution and the number average distribution.

For the divided particle size ranges (channels) of the measured particle size distribution, the accumulated distributions are drawn from the small size side each for the volume and the number with the premise that the particle size to have the 16% accumulation is defined to be D16v and the number as D16p, and the particle size to have the 50% accumulation is defined to be D50v and the number as D50p. In the same manner, the particle size to have the 84% accumulation is defined to be D84v and the number as D84p. Here, the volume average particle size denotes D50v, the volume average particle size distribution index (GSDv) is represented as $(D84v/D16v)^{0.5}$, and the number average particle size distribution index (GSDp) is represented as $(D84p/D16p)^{0.5}$.

(Measurement of the Shape Factor SF1 of the Toner)

As to the toner shape factor SF1, the optical microscope image of a toner scattered on a slide glass is taken into a Ruzex image analyzing device through a video camera, and the maximum length of 50 or more pieces of the toners and the toner projection area are measured so as to calculate by the following equation (2). In the calculation, an average value of 50 pieces or more toners is calculated.

$$SF1 = \left(\frac{(\text{toner size absolute maximum length})^2}{\text{toner projection area}}\right) \times (\pi/4) \times 100 \quad \text{Equation (2)}$$

(Method for Measuring the Molecular Weight of the Binder Resin)

For the molecular weight measurement of the binder resin, as the GPC (gel permeation chromatography), "HLC-8120GPC, SC-8020 (produced by Tosoh Corporation) device" is used, as the column, two pieces of "TSK gel, Super HM-H (produced by Tosoh Corporation), 6.0 mm ID×15 cm)" are used, and as the eluting solvent, THF (tetrahydro furan) is used.

The measurement is carried out with a 0.5% specimen concentration, a 0.6 ml/min flow rate, a 10 μl sample injection amount, a 40° C. measurement temperature, and an IR detector. Moreover, calibration curves are produced by 10 samples of the "polystyrene standard specimens TSK standard" produced by Tosoh Corporation, "A-500", "F-1", "F-10", "F-80", "F-380", "A-2500", "F-4", "F-40", "F-128", and "F-700".

Hereinafter, the invention will be explained further specifically with reference to the examples, but the invention is not limited to these examples. In the description below, the "part" denotes the "part by mass" unless otherwise specified.

<Preparation of the Resin Particle Dispersion A>

| | |
|---|---|
| Styrene (produced by Wako Pure Chemical Industries, Ltd.): | 270 parts by weight |
| N-butyl acrylate (produced by Wako Pure Chemical Industries, Ltd.): | 140 parts by weight |
| β-carboxy ethyl acrylate (produced by Rodia Nikka): | 12 parts by weight |
| 1,10-decanediol diacrylate (produced by Shin Nakamura Kagaku Co.): | 1.5 parts by weight |
| Dodecane thiol (produced by Wako Pure Chemical Industries, Ltd.): | 6.5 parts by weight |

To the solution with the above-mentioned components mixed and dissolved, a solution with 4 parts of an anionic surfactant Dowfacs (produced by Dow Chemical Corp.) dissolved in 550 parts of ion exchange water is added so as to be dispersed and emulsified in a flask. While slowly agitating and mixing the same for 10 minutes, 50 parts of ion exchange water with 6 parts of an ammonium persulfate dissolved is poured therein.

Then, after sufficiently carrying out the nitrogen substitution in the vessel, a heating operation is carried out until the inside of the vessel becomes 75° C. with an oil bath while agitating the flask so as to continue the emulsion polymerization as it is for 5 hours.

Thereby, a resin particle dispersion A including an anionic resin having a 192 nm volume average particle size, a 43% by mass solid component content, a 31.3° C. glass transition temperature and a 31,000 weight average molecular weight Mw is obtained. The calculated SP value of the resin is 9.87.

<Preparation of the Resin Particles B>

| | |
|---|---|
| Styrene (produced by Wako Pure Chemical Industries, Ltd.): | 40 parts by weight |
| N-butyl acrylate (produced by Wako Pure Chemical Industries, Ltd.): | 60 parts by weight |
| Methyl methacrylate (produced by Wako Pure Chemical Industries, Ltd.): | 310 parts by weight |
| β-carboxy ethyl acrylate (produced by Rodia Nikka): | 12 parts by weight |
| 1,10-decanediol diacrylate (produced by Shin Nakamura Kagaku Co.): | 1.5 parts by weight |
| Dodecane thiol (produced by Wako Pure Chemical Industries, Ltd.): | 6.5 parts by weight |

To the solution with the above-mentioned components mixed and dissolved, a solution with 4 parts of an anionic surfactant Dowfacs (produced by Dow Chemical Corp.) dissolved in 550 parts of ion exchange water is added so as to be dispersed and emulsified in a flask. While slowly agitating and mixing the same for 10 minutes, 50 g of ion exchange water with 6 parts of an ammonium persulfate dissolved is poured therein.

Then, after sufficiently carrying out the nitrogen substitution in the vessel, a heating operation is carried out until the inside of the vessel becomes 75° C. with an oil bath while agitating the flask so as to continue the emulsion polymerization as it is for 5 hours. Thereby, a resin particle dispersion B including an anionic resin having a 173 nm volume average particle size, a 43% by mass solid component content, a 68.7° C. glass transition temperature and a 29,000 weight average molecular weight Mw is obtained. The calculated SP value of the resin is 9.60.

<Preparation of the Resin Particle Dispersion C>

After putting 29.0 g of a 1,9-nonane diol, 205.2 g of an EO addition product of a bisphenol A, 90.0 g of a dimethyl terephthalate, 90.0 g of a dimethyl isophthalate, and 0.12 g of a dibutyl tin oxide as a catalyst in a three neck flask heated and dried, the air in the container is vacuumed by a pressure reducing operation, furthermore, in an inert atmosphere produced with a nitrogen gas, reflux is carried out at 180° C. for 6 hours with the mechanical agitation.

Thereafter, while agitating for 5 hours with the temperature raising gradually to 200° C. by the reduced pressure distillation, at the time it reaches at a viscous state, the molecular weight is confirmed by the GPC (gel permeation chromatography. At the time a 10,500 weight average molecular weight is obtained, the reduced pressure distillation is stopped. By cooling down with the air, a binder resin for the core layer is obtained. The acid value is 9.8 mgKOH/g. Moreover, the glass transition temperature is 44.9° C.

Then, it is conveyed at a 100 g per minute rate by Cavitron CD 1010 (produced by Eurotech Corp.) in a molten state. With a 0.37% by mass concentration diluted ammonia water produced by diluting reagent ammonia water with ion exchange water placed in a water based medium tank prepared independently, while heating to 120° C. by a heat exchanger, it is conveyed to the above-mentioned Cavitron simultaneously with the above-mentioned polyester resin molten product by a 0.1 liter per minute rate. In this state, the Cavitron is operated by the 60 Hz rotation rate of the rotor and 5 kg/cm$^2$ pressure so as to obtain a resin particle dispersion C containing binder resin particles of a 0.38 μm volume average particle size. Moreover, the water content is adjusted so as to have the resin particle concentration of 20% by mass. The calculated SP value of the resin is 9.80.

<Preparation of the Resin Particle Dispersion D>

| | |
|---|---|
| Bisphenol A-propylene oxide addition product (average added mole number 2.2): | 400 parts |
| Trimethylol propane: | 400 parts |
| Terephthalic acid: | 1,600 parts |

By the same process as in the preparation of the resin particle dispersion C except that a solution with the above-mentioned components mixed is used, reaction is carried out until a 10.5 mgKOH/g acid value and a 110° C. softening point are obtained so as to obtain a binder resin having a 10,500 weight average molecular weight and a 62.5° C. glass transition temperature.

Then, by the same conditions as the resin particle dispersion C preparing conditions, it is emulsified and dispersed by the Cavitron so as to obtain a resin particle dispersion D containing an amorphous polyester resin having a 0.10 μm volume average particle size. Moreover, the water content is adjusted so as to have the resin particle concentration of 20% by mass. The calculated SP value of the resin is 10.21.

<Preparation of the Resin Particle Dispersion E>

| | |
|---|---|
| Styrene (produced by Wako Pure Chemical Industries, Ltd.): | 315 parts by weight |
| N-butyl acrylate (produced by Wako Pure Chemical Industries, Ltd.): | 95 parts by weight |
| β-carboxy ethyl acrylate (produced by Rodia Nikka): | 12 parts by weight |
| 1,10-decanediol diacrylate (produced by Shin Nakamura Kagaku Co.): | 1.5 parts by weight |
| Dodecane thiol (produced by Wako Pure Chemical Industries, Ltd.): | 6.0 parts by weight |

To the solution with the above-mentioned components mixed and dissolved, a solution with 4 parts of an anionic surfactant Dowfacs (produced by Dow Chemical Corp.) dissolved in 550 parts of ion exchange water is added so as to be dispersed and emulsified in a flask. While slowly agitating and mixing the same for 10 minutes, 50 parts of ion exchange water with 6 parts of an ammonium persulfate dissolved is poured therein.

Then, after sufficiently carrying out the nitrogen substitution in the vessel, a heating operation is carried out until the inside of the vessel becomes 75° C. with an oil bath while agitating the flask so as to continue the emulsion polymerization as it is for 5 hours.

Thereby, a resin particle dispersion E including an anionic resin having a 200 nm volume average particle size, a 43% by mass solid component content, a 51.5° C. glass transition temperature and a 31,000 weight average molecular weight Mw is obtained. The calculated SP value of the resin is 9.94.

<Preparation of the Resin Particle Dispersion F>

| | |
|---|---|
| Styrene (produced by Wako Pure Chemical Industries, Ltd.): | 290 parts by weight |
| N-butyl acrylate (produced by Wako Pure Chemical Industries, Ltd.): | 120 parts by weight |
| β-carboxy ethyl acrylate (produced by Rodia Nikka): | 12 parts by weight |
| 1,10-decanediol diacrylate (produced by Shin Nakamura Kagaku Co.): | 1.5 parts by weight |
| Dodecane thiol (produced by Wako Pure Chemical Industries, Ltd.): | 6.0 parts by weight |

To the solution with the above-mentioned components mixed and dissolved, a solution with 4 parts of an anionic surfactant Dowfacs (produced by Dow Chemical Corp.) dissolved in 550 parts of ion exchange water is added so as to be dispersed and emulsified in a flask. While slowly agitating and mixing the same for 10 minutes, 50 parts of ion exchange water with 6 parts of an ammonium persulfate dissolved is poured therein.

Then, after sufficiently carrying out the nitrogen substitution in the vessel, a heating operation is carried out until the inside of the vessel becomes 75° C. with an oil bath while agitating the flask so as to continue the emulsion polymerization as it is for 5 hours.

Thereby, a resin particle dispersion F including an anionic resin having a 195 nm volume average particle size, a 43% by mass solid component content, a 41.1° C. glass transition temperature and a 29,500 weight average molecular weight Mw is obtained. The calculated SP value of the resin is 9.90.

<Preparation of the Coloring Agent Dispersion H>

| | |
|---|---|
| Carbon black (R330 produced by Cavot Corp.): | 50 parts by weight |
| Ionic surfactant (Neogen RK, Produced by Daiichi Kogyo Seiyaku): | 4 parts by weight |
| Ion exchange water: | 250 parts by weight |

A coloring agent dispersion H with the coloring agent particles having a 150 nm volume average particle size is obtained by mixing and dissolving the above-mentioned components, dispersing the same by a homogenizer (IKA Ultra Tarax) for 10 minutes, and directing a 28 kHz ultrasonic wave for 10 minutes using a ultrasonic dispersing machine.

<Preparation of the Coloring Agent Dispersion I>

| | |
|---|---|
| Copper phthalocyanine pigment (produced by BASF Corp.): | 50 parts by weight |
| Ionic surfactant (Neogen SC, Produced by Daiichi Kogyo Seiyaku): | 8 parts by weight |
| Ion exchange water: | 250 parts by weight |

A coloring agent dispersion I with the coloring agent particles having a 180 nm volume average particle size is obtained by mixing and dissolving the above-mentioned components, dispersing the same by a homogenizer (IKA Ultra Tarrux) for 10 minutes, and directing a ultrasonic wave for 20 minutes using a ultrasonic dispersing machine.

<Preparation of the Magnetic Metal Particle Dispersion H>

A solution prepared by dissolving 5 parts by weight of a γ-amino propyl triethoxy silane in 100 parts by weight of pure water as the surface treatment agent is added to 100 parts by weight of ferrite particles having a 90 nm central particle size (MTS010: produced by Toda Kogyo Corp.) so that a covering layer is formed on the ferrite particle surface while agitating moderately for 30 minutes.

Then, a magnetic metal particle dispersion H with the surfactant adsorbed on the surface of the magnetic metal particles is obtained by adding Neogen SC (produced by Daiichi Kogyo Seiyaku Corp.) as the surfactant by a 5% by mass ratio, raising the temperature to 40° C. and agitating for 30 minutes.

<Preparation of the Magnetic Metal Particle Dispersion I>

A magnetic metal particle dispersion I is obtained by the same operation as in the case of the preparation of the magnetic metal particle dispersion H except that EPM012S1 having a 120 nm particle size (produced by Toda Kogyo Corp.) is used instead of the ferrite particles, an isopropyl titanium triisostearate is used instead of the surface treatment agent, and a dodecyl benzene sodium sulfonate (addition amount 8.4 parts by weight) is used instead of the surfactant.

<Preparation of the Magnetic Metal Particle Dispersion J>

A magnetic particle dispersion J is produced in the same manner as in the magnetic metal particle dispersion H except that the ferrite particle surface is not treated with the surface processing agent.

<Preparation of the Magnetic Metal Particle Dispersion K>

A magnetic particle dispersion K is obtained in the same manner as in the magnetic metal particle dispersion I except that MTH009F having a 300 nm particle size (produced by Toda Kogyo Corp.) is used instead of the ferrite particles and it is used without applying the surface treatment.

<Preparation of the Releasing Agent Dispersion L>

| | |
|---|---|
| Paraffin wax FNP0090 (melting point 90.2° C., produced by Nihon Seirou Co.): | 50 parts by weight |
| Ionic surfactant (Neogen RK, produced by Daiichi Kogyo Seiyaku): | 5 parts by weight |
| Ion exchange water: | 200 parts by weight |

A releasing agent dispersion having a 220 nm volume average particle size and a 25% by mass solid content is obtained by heating a solution with the above-mentioned components mixed, dispersing the same sufficiently with Ultra Tarrux T50 produced by IKA, and applying a dispersion process with a pressure discharge type Gorin homogenizer.

<Preparation of the Releasing Agent Dispersion M>

A releasing agent dispersion M having a 210 nm volume average particle size is obtained by the same operation as in the preparation of the releasing agent dispersion L except that a polyethylene wax PW725 (melting point 104° C., produced by Toyo Petrolite) is used instead of the paraffin wax FNP0090 (melting point 90.2° C., produced by Nihon Seirou Corp.).

—Production of a Toner for a Two Component Developer—

<Production of the Toner Mother Particles O1>

| | |
|---|---|
| Resin particle dispersion A: | 80 parts by weight |
| Coloring agent dispersion H: | 30 parts by weight |
| Releasing agent dispersion L: | 30 parts by weight |

The above-mentioned components are heated to 20° C. while agitating in a round stainless steel flask. Thereafter, it is mixed and dispersed sufficiently with Ultra Tarrux T50.

Then, with 1.2 parts by weight of an polyaluminum chloride added thereto, the dispersing operation is continued with the Ultra Tarrux. Thereafter, while agitating in a heating oil bath, the flask is heated to 30° C. After maintaining at 30° C. for 60 minutes, 40 parts by weight of the resin particle dispersion B is added moderately thereto.

Then, after having the pH in the vessel to 5.5 by adding 0.5 mol/l of a sodium hydroxide aqueous solution, the stainless steel flask is sealed tightly. While continuing the agitating operation with a magnetic force seal, the temperature is raised to 95° C. and maintained for 5 hours. While the maintaining the temperature, the shape factor SF1 is adjusted to 132 using 0.5 mol/L of a sodium hydroxide or 0.5 mol/l of a nitric acid.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 6.6, and the electric conductivity is 12 μS/cm. Then, the vacuum drying is continues for 12 hours.

The particle size at the time is measured with a Coulter counter so as to find the volume average particle size of 6.5 μm. The volume average particle size distribution index GSDv is 1.20.

<Production of the Toner Mother Particles P1>

| | |
|---|---|
| Resin particle dispersion C: | 170 parts by weight |
| Coloring agent dispersion I: | 30 parts by weight |
| Releasing agent dispersion M: | 30 parts by weight |

The above-mentioned components are heated to 20° C. while agitating in a round stainless steel flask. Thereafter, while dispersing with Ultra Tanux T50 in a heating oil bath, 1.4 parts by weight of a polyaluminum chloride is added. The temperature is raised to 45° C. and maintained for 50 minutes. Then, 60 parts by weight of the resin particle dispersion D is added, and furthermore, the pH in the vessel is adjusted to 3.2.

Thereafter, the grain growth is carried out for 2 hours only with the agitating operation. At the time the particle size becomes 6.6 μm, the pH in the vessel is adjusted to 9. After raising the temperature again to 98° C., the toner shape is adjusted by the pH and the maintaining time, and the shape factor SF1 is adjusted to 130. The maintaining time is consequently 3 hours.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 6.6, and the electric conductivity is 12 μS/cm. Then, the vacuum drying is continues for 12 hours.

The particle size at the time is measured with a Coulter counter so as to find the volume average particle size of 6.7 μm. The volume average particle size distribution index GSDv is 1.26.

<Production of the Toner Mother Particles Q1>

Toner mother particles Q1 having a shape factor SF1 of 131, a 6.4 μm volume average particle size are obtained in the same method as in the production of the toner mother particles O1 except that the resin particle dispersion F is used instead of the resin particle dispersion A. The volume average particle size distribution index GSDv is 1.20.

<Production of the Toner Mother Particles R1>

Toner mother particles R1 having a shape factor SF1 of 127, a 6.5 μm volume average particle size are obtained in the same method as in the production of the toner mother particles O1 except that the resin particle dispersion A is used instead of the resin particle dispersion B. The volume average particle size distribution index GSDv is 1.21.

<Production of the Toner Mother Particles S1>

Toner mother particles S1 having a shape factor SF1 of 129, a 6.4 μm volume average particle size are obtained in the same method as in the production of the toner mother particles O1 except that the resin particle dispersion E is used instead of the resin particle dispersion B, and the fusing time is changed to 6 hours. The volume average particle size distribution index GSDv is 1.20.

<Production of the Toner Mother Particles T1>

| | |
|---|---|
| Resin particle dispersion D: | 175 parts by weight |
| Coloring agent dispersion I: | 30 parts by weight |
| Releasing agent dispersion M: | 30 parts by weight |

The above-mentioned components are heated to 20° C. while agitating in a round stainless steel flask. Thereafter, while dispersing with Ultra Tarrux T50 in a heating oil bath, 1.4 parts by weight of a polyaluminum chloride is added. After sufficiently dispersing, the temperature is raised to 65° C. and maintained for 30 minutes. Then, 60 parts by weight of the resin particle dispersion B is added, and furthermore, the pH in the vessel is adjusted to 3.2. Thereafter, the grain growth is carried out for 1 hour only with the agitating operation. At the time the particle size becomes 6.3 μm, the pH in the vessel is adjusted to 9.5.

After raising the temperature again to 98° C., the toner shape is adjusted by the pH and the maintaining time, and the shape factor SF1 is adjusted to 130. The maintaining time is consequently 3 hours.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 7.5, and the electric conductivity is 23 μS/cm. Then, the vacuum drying is continues for 10 hours so as to obtain the toner mother particles T1.

The particle size at the time is measured with a Coulter counter so as to find the volume average particle size of 6.9 μm. The volume average particle size distribution index GSDv is 1.26.

<Production of the Toner Mother Particles U1>

Toner mother particles U1 having a shape factor SF1 of 130, a 6.8 μm volume average particle size are obtained in the same method as in the production of the toner mother particles O1 except that the resin particle dispersion E is used instead of the resin particle dispersion A, and the temperature at the time of aggregation is changed from 32° C. to 50° C. The volume average particle size distribution index GSDv is 1.20.

<Production of the Toner Mother Particles V1>

Toner mother particles V1 having a shape factor SF1 of 135, a 6.5 μm volume average particle size are obtained in the same method as in the production of the toner mother particles O1 except that the resin particle dispersion C is used instead of the resin particle dispersion B. The volume average particle size distribution index GSDv is 1.22.

—Production of a Toner for a One Component Developer—

<Production of the Toner Mother Particles O2>

| | |
|---|---|
| Resin particle dispersion A: | 80 parts by weight |
| Magnetic metal particle dispersion H: | 80 parts by weight |
| Releasing agent dispersion L: | 40 parts by weight |

The above-mentioned components are heated to 20° C. while agitating in a round stainless steel flask. Thereafter, it is mixed and dispersed sufficiently with Ultra Tanux T50.

Then, with 1.2 parts by weight of a polyaluminum chloride added thereto, the dispersing operation is continued with the Ultra Tarrux. Thereafter, while agitating in a heating oil bath, the flask is heated to 30° C. After maintaining at 30° C. for 50 minutes, 40 parts by weight of the resin particle dispersion B is added moderately thereto.

Then, after having the pH in the vessel to 5.5 by adding 0.5 mol/l of a sodium hydroxide aqueous solution, the stainless steel flask is sealed tightly. While continuing the agitating operation with a magnetic force seal, the temperature is raised to 95° C. and maintained for 5 hours. While the maintaining the temperature, the shape factor SF1 is adjusted to 135 using 0.5 mol/l of a sodium hydroxide or 0.5 mol/l of a nitric acid.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 7.0, and the electric conductivity is 25 μS/cm. Then, the vacuum freezing drying is continues for 12 hours.

The particle size at the time is measured with a Coulter counter so as to find the volume average particle size of 6.5 μm. The volume average particle size distribution index GSDv is 1.23.

<Production of the Toner Mother Particles P2>

| | |
|---|---|
| Resin particle dispersion C: | 170 parts by weight |
| Coloring agent dispersion I: | 90 parts by weight |
| Releasing agent dispersion M: | 40 parts by weight |

The above-mentioned components are heated to 20° C. while agitating in a round stainless steel flask. Thereafter, while dispersing with Ultra Tarrux T50 in a heating oil bath, 1.4 parts by weight of a polyaluminum chloride is added. The temperature is raised to 45° C. and maintained for 50 minutes. Then, 60 parts by weight of the resin particle dispersion D is added, and furthermore, the pH in the vessel is adjusted to 3.2.

Thereafter, the grain growth is carried out for 2 hours only with the agitating operation. At the time the particle size becomes 6.6 μm, the pH in the vessel is adjusted to 9. After raising the temperature again to 98° C., the toner shape is adjusted by the pH and the maintaining time, and the shape factor SF1 is adjusted to 128. The maintaining time is consequently 3 hours.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 7.2, and the electric conductivity is 18 μS/cm. Then, the vacuum drying is continues for 12 hours.

The particle size at the time is measured with a Coulter counter so as to find the volume average particle size of 7.1 μm. The volume average particle size distribution index GSDv is 1.22.

<Production of the Toner Mother Particles Q2>

Toner mother particles Q2 having a shape factor SF1 of 135, a 6.8 μm volume average particle size are obtained in the same method as in the production of the toner mother particles O2 except that the resin particle dispersion F is used instead of the resin particle dispersion A, and the magnetic metal particle dispersion I is used instead of the magnetic metal particle dispersion H. The volume average particle size distribution index GSDv is 1.21.

<Production of the Toner Mother Particles R2>

Toner mother particles R2 having a shape factor SF1 of 127, a 6.4 μm volume average particle size are obtained in the same method as in the production of the toner mother particles O2 except that the resin particle dispersion A is used instead of the resin particle dispersion B. The volume average particle size distribution index GSDv is 1.22.

<Production of the Toner Mother Particles S2>

Toner mother particles S2 having a shape factor SF1 of 134, a 6.4 μm volume average particle size are obtained in the same method as in the production of the toner mother particles O2 except that the resin particle dispersion E is used instead of the resin particle dispersion B, the magnetic metal particle dispersion J is used instead of the magnetic metal particle dispersion H, and the fusing time is changed to 6 hours. The volume average particle size distribution index GSDv is 1.20.

<Production of the Toner Mother Particles T2>

| | |
|---|---|
| Resin particle dispersion D: | 175 parts by weight |
| Magnetic metal particle dispersion I: | 80 parts by weight |
| Releasing agent dispersion M: | 30 parts by weight |

The above-mentioned components are heated to 20° C. while agitating in a round stainless steel flask. Thereafter, while dispersing with Ultra Tarrux T50 in a heating oil bath, 1.4 parts by weight of a polyaluminum chloride is added. After sufficiently dispersing, the temperature is raised to 50° C. and maintained for 30 minutes. Then, 60 parts by weight of the resin particle dispersion B is added, and furthermore, the pH in the vessel is adjusted to 3.2.

Thereafter, the grain growth is carried out for 1 hour only with the agitating operation. At the time the particle size becomes 6.3 μm, the pH in the vessel is adjusted to 9.5. After raising the temperature again to 98° C., the toner shape is adjusted by the pH and the maintaining time, and the shape factor SF1 is adjusted to 135. The maintaining time is consequently 3 hours.

After finishing the reaction, it is cooled down, filtrated and washed sufficiently with ion exchange water. Then, the solid and the liquid are separated by a Nutsche type vacuum filtration. Furthermore, it is dispersed again in 3 L of ion exchange water of 40° C., and it is agitated and washed for 15 minutes by 300 rpm.

By further repeating the operation for 5 times, the solid and the liquid are separated using No. 5A filtrating paper by the Nutsche type vacuum filtration at the time the pH of the filtrated liquid is 7.5, and the electric conductivity is 23 μS/cm. Then, the vacuum drying is continues for 10 hours so as to obtain the toner mother particles T2.

The particle size at the time is measured with a Coulter counter so as to find the volume average particle size of 6.9 μm. The volume average particle size distribution index GSDv is 1.26.

<Production of the Toner Mother Particles U2>

Toner mother particles U2 having a shape factor SF1 of 132, a 6.8 μm volume average particle size are obtained in the same method as in the production of the toner mother particles O2 except that the resin particle dispersion E is used instead of the resin particle dispersion A, and the temperature at the time of aggregation is changed from 32° C. to 50° C. The volume average particle size distribution index GSDv is 1.22.

<Production of the Toner Mother Particles V2>

Toner mother particles V2 are obtained in the same method as in the production of the toner mother particles S2 except that the magnetic metal particle dispersion K is used instead of the magnetic metal particle dispersion J. The particle size of the obtained toner mother particles is 7.3 μm, and the volume average particle size distribution index GSDv is 1.28. However, by observing the filtrated liquid during the production, and it is confirmed that the magnetic metal particles are present freely or on the mother particle surface apparently without being taken into the toner particles.

—Addition of the External Additive and Production of the Developer—

As to the toner mother particles O1 to V1 and the toner mother particles O2 to V2 produced as mentioned above, 0.8 part by mass of a titania treated with a decyl trimethoxy silane having a 30 nm volume average particle size and 1.2 parts by weight of a silica treated with a hexamethyl disilazane having a 70 nm volume average particle size are added to 100 parts by weight of the toner mother particles as the external additives, mixed for 10 minutes with a 5 L Henschel mixer (produced by Mitsui Miike Kakoki Corp.), and furthermore, sifted by a gyrosifter (mesh aperture 45 μm) so as to obtain each toners A1 to A8, and toners B1 to B8 (developers B1 to B8).

Furthermore, for the toner mother particles O1, Q 1, toners without addition of the silica having the hexamethyl disilazane process are produced by the same method as mentioned above so as to obtain toners A9, A10.

Moreover, developers A1 to A10 are obtained by mixing 93 parts by weight by the weight ratio of a carrier obtained by coating 0.8% by mass of a silicone resin (SR2411: produced by Toray-Dow Corning Silicone Corp.) to the ferrite core having a 35 μm particle size using a kneader device and each 7 parts by weight of the above-mentioned toners A1 to A10 by a V type blender.

<Evaluation of the Two Component Developers>

For the produced two component developers A1 to A10, a fixing test is carried out using a DocuColor 500 modified machine with the variable processing speed in a condition with the process speed fixed at 140 mm/sec and the fixing temperature varied in a range of 80 to 180° C.

Furthermore, for the obtained developers A1 to A10, a 50,000 sheets image quality maintenance test is carried out using the DocuColor 500 modified machine, with the fixing temperature: lowest fixing temperature +20° C. and the processing speed: 160 mm/sec under the 30° C., 90% RH environment. Additionally, the document storage property is evaluated using the samples obtained in the image quality maintenance test.

Furthermore, a 1,000 sheets initial image quality test is carried out with the above-mentioned DocuColor 500 modified machine with the fixing temperature: lowest fixing temperature +20° C. and the processing speed: 160 mm/sec after leaving the obtained toners/developers A1 to A10 for 60 hours in the 50° C., 50% RH environment, and furthermore, 55° C., 50% RH environment.

Furthermore, for the toners left, 100 g thereof is sieved manually with a mesh having a 106 μm aperture for observing the blocking state.

Furthermore, as to the obtained toners, the tangent loss is calculated from the dynamic visco-elasticity measurement, and the number of the peaks and the temperatures at which the peaks appear are measured.

<Evaluation of the One Component Developers>

For the produced one component developers B1 to B8, a fixing test is carried out using an Able 3350 modified machine with the variable processing speed in a condition with the process speed fixed at 180 mm/sec and the fixing temperature varied in a range of 80 to 180° C.

Furthermore, for the obtained developers B1 to B8, a 10,000 sheets image quality maintenance test is carried out using the Able 3350 modified machine, with the fixing temperature: lowest fixing temperature +20° C. and the processing speed: 180 mm/sec under the 30° C., 90% RH environment. Additionally, the image bending strength is evaluated using the samples obtained in the image quality maintenance test.

Furthermore, a 1,000 sheets initial image quality test is carried out with the above-mentioned Able 3350 modified machine with the fixing temperature: lowest fixing temperature +20° C. and the processing speed: 180 mm/sec after leaving the obtained developers B1 to B8 (toners B1 to B8) for 60 hours in the 50° C., 50% RH environment, and furthermore, 55° C., 50% RH environment.

Furthermore, for the toners left, 100 g thereof is sieved manually with a mesh having a 106 μm aperture for observing the blocking state.

Furthermore, as to the obtained toners, the tangent loss is calculated from the dynamic visco-elasticity measurement, and the number of the peaks and the temperatures at which the peaks appear are measured.

<Measurement of the Tangent Loss>

The tangent loss is measured by the dynamic visco-elasticity measured by the sine wave vibration method. For the measurement of the dynamic visco-elasticity, the ARES measurement device produced by Rheometric Scientific Ltd., is used. For the measurement of the dynamic visco-elasticity, after shaping a toner into a tablet, it is set on a 8 mm diameter parallel plate. After setting the normal force at 0, a sine wave vibration is applied by a 6.28 rad/sec vibration frequency. Measurement is started at 20° C. and continued until 100° C.

The measurement time interval is 30 seconds, and the temperature raising rate is 1° C./min. Moreover, before executing the measurement, the stress dependency of the distortion amount is confirmed from 20° C. to 100° C. by the 10° C. interval so as to find the distortion amount range with the stress and the distortion amount at each temperature having a linear relationship. While maintaining the distortion amount at each measurement temperature in a range of 0.01% to 0.5% during the measurement for controlling the stress and the distortion amount in a linear relationship in the all measurement temperature range, the storage elastic modulus, the loss elastic modulus, and the tangent loss are calculated form the measurement results.

The evaluation results of the fixing property, the storage property (manual sieve test, initial image quality), the image quality maintenance property, the document storage property and the image bending strength of these toners are shown in the tables 1 and 2.

TABLE 1

| | | glass transition temperature of the binder resin | | measurement of the tangent loss in a range of 30 to 90° C. | | difference of the SP values of the binder resin for the core layer and | whether or not silica particles (particle | | |
|---|---|---|---|---|---|---|---|---|---|
| | kind of the toner | binder resin for the core layer | binder resin for the shell layer | number of the peaks | temperature at which the peak is measured | the binder resin for the shell layer | size 70 nm) are added externally | fixing property lowest fixing temperature | fixing property evaluation |
| example A1 | A1 | 31.3° C. | 68.7° C. | 2 | 46/81 | 0.27 | yes | 95° C. | G1 |
| example A2 | A2 | 44.9° C. | 62.5° C. | 2 | 56/78 | 0.42 | yes | 95° C. | G1 |
| example A3 | A3 | 41.1° C. | 68.7° C. | 2 | 55/81 | 0.30 | yes | 110° C. | G2 |
| example A4 | A9 | 31.3° C. | 68.7° C. | 2 | 46/81 | 0.27 | no | 95° C. | G1 |
| example A5 | A10 | 41.1° C. | 68.7° C. | 2 | 55/81 | 0.30 | no | 110° C. | G2 |
| comparative example A1 | A4 | 31.3° C. | 31.3° C. | 1 | 45 | 0.00 | yes | 95° C. | G1 |
| comparative example A2 | A5 | 31.3° C. | 51.5° C. | 1 | 56 | 0.07 | yes | 110° C. | G2 |
| comparative example A3 | A6 | 62.5° C. | 68.7° C. | 1 | 80 | 0.62 | yes | 160° C. | G5 |

TABLE 1-continued

| | | | | | | | | | |
|---|---|---|---|---|---|---|---|---|---|
| comparative example A4 | A7 | 51.5° C. | 68.7° C. | 2 | 64/83 | 0.34 | yes | 140° C. | G5 |
| comparative example A5 | A8 | 31.3° C. | 44.9° C. | 2 | 43/56 | 0.10 | yes | 95° C. | G1 |

| | storage property (manual sieve test with a 106 μm aperture mesh) | | storage property (initial image quality evaluation) | | image quality maintenance test | | | | |
|---|---|---|---|---|---|---|---|---|---|
| | 50° C. 50% RH | 55° C. 50% RH | 50° C. 50% RH | 55° C. 50% RH | fogging | defects such as black stripes and dropping | density reproduction maintenance | document storage property | total evaluation |
| example A1 | G1 | G2 | G1 | G2 | G2 | G2 | G2 | G3 | G2 |
| example A2 | G1 | G1 | G1 | G1 | G2 | G1 | G1 | G1 | G1 |
| example A3 | G1 | G1 | G1 | G2 | G2 | G2 | G2 | G2 | G2 |
| example A4 | G2 | G2 | G2 | G3 | G2 | G2 | G2 | G3 | G2 |
| example A5 | G1 | G2 | G1 | G2 | G2 | G2 | G2 | G2 | G2 |
| comparative example A1 | G5 | G5 | G5 | G5 | G5 | G4 | G4 | G5 | G4 |
| comparative example A2 | G4 | G5 | G4 | G5 | G4 | G4 | G4 | G4 | G4 |
| comparative example A3 | G1 | G1 | G1 | G1 | G2 | G2 | G2 | G1 | G4 |
| comparative example A4 | G1 | G2 | G1 | G2 | G2 | G2 | G2 | G2 | G4 |
| comparative example A5 | G5 | G5 | G5 | G5 | G4 | G3 | G3 | G5 | G4 |

*difficulty in specifying the peak

TABLE 2

| | | glass transition temperature of the binder resin | | measurement of the tangent loss in a range of 30 to 90° C. | | difference of the SP values of the binder resin for the core layer and the binder resin for the shell layer | magnetic metal particles | | fixing property | |
|---|---|---|---|---|---|---|---|---|---|---|
| | kind of the toner | binder resin for the core layer | binder resin for the shell layer | number of the peaks | temperature at which the peak is measured | | whether or not the covering layer is provided | volume average particle size | lowest fixing temperature | evaluation |
| example A1 | B1 | 31.3° C. | 68.7° C. | 2 | 47/81 | 0.27 | yes | 90 nm | 95° C. | G1 |
| example A2 | B2 | 44.9° C. | 62.5° C. | 2 | 56/77 | 0.42 | yes | 120 nm | 95° C. | G1 |
| example A3 | B3 | 41.1° C. | 68.7° C. | 2 | 55/81 | 0.30 | yes | 120 nm | 110° C. | G2 |
| comparative example B1 | B4 | 31.3° C. | 31.3° C. | 1 | 45 | 0.00 | yes | 90 nm | 95° C. | G1 |
| comparative example B2 | B5 | 31.3° C. | 51.5° C. | 1 | 56 | 0.07 | No | 90 nm | 110° C. | G2 |
| comparative example B3 | B6 | 62.5° C. | 68.7° C. | 2 | 77/83 | 0.62 | Yes | 120 nm | 105° C. | G2 |
| comparative example B4 | B7 | 51.5° C. | 68.7° C. | 2 | 64/83 | 0.34 | Yes | 90 nm | 140° C. | G5 |

TABLE 2-continued

| | | | | | | | | | | |
|---|---|---|---|---|---|---|---|---|---|---|
| comparative example B5 | B8 | 31.3° C. | 51.5° C. | 1 | 56 | 0.07 | No | 300 nm | 125° C. | G4 |

| | storage property (manual sieve test with a 106 μm aperture mesh) | | storage property (initial image quality evaluation) | | image quality maintenance test | | | | |
|---|---|---|---|---|---|---|---|---|---|
| | 50° C. 50% RH | 55° C. 50% RH | 50° C. 50% RH | 55° C. 50% RH | fogging | defects such as black stripes and dropping | density reproduction maintenance | image bending strength | total evaluation |
| example A1 | G1 | G1 | G1 | G2 | G2 | G2 | G2 | G3 | G2 |
| example A2 | G1 | G2 | G1 | G2 | G2 | G2 | G2 | G1 | G1 |
| example A3 | G1 | G1 | G1 | G1 | G2 | G2 | G2 | G2 | G2 |
| comparative example B1 | G5 | G5 | G5 | G5 | G2 | G4 | G4 | G4 | G4 |
| comparative example B2 | G4 | G5 | G4 | G5 | G2 | G4 | G4 | G4 | G4 |
| comparative example B3 | G3 | G2 | G5 | G5 | G4 | G2 | G5 | G2 | G4 |
| comparative example B4 | G1 | G1 | G1 | G2 | G2 | G2 | G2 | G2 | G4 |
| comparative example B5 | G4 | G5 | G4 | G5 | G5 | G3 | G4 | G4 | G4 |

The evaluation criteria shown in the tables 1 and 2 are as follows.

(Fixing Property Evaluation)

For the fixing property evaluation, the lowest fixing temperature without generation of the offset while changing the fixing temperature (lowest fixing temperature) is measured and it is evaluated according to the following criteria.

G1: less than 100° C. lowest fixing temperature

G2: 100° C. or more and less than 110° C. lowest fixing temperature

G3: 110° C. or more and less than 120° C. lowest fixing temperature

G4: 120° C. or more and less than 130° C. lowest fixing temperature

G5: 130° C. or more lowest fixing temperature (Storage Property (Manual Sieve Test))

After storing in each environment, the residual amount of the toner remaining on the sieve at the time of sieving 100 g of the toner with a 106 μm aperture standard sieve is measured and it is evaluated according to the following criteria.

G1: 0 g remaining amount

G2: more than 0 g and less than 0.5 g remaining amount

G3: more than 0.5 g and less than 1.0 g remaining amount

G4: more than 1.0 g and less than 2.0 g remaining amount

G5: more than 2.0 g remaining amount (Storage Property (Evaluation of the Initial Image Quality))

After storing the toner in each environment, a developer is produced and it is placed in an actual machine for observing the image quality defect state of the initial image quality (first to $1{,}000^{th}$). The evaluation criteria are as follows.

G1: no problem in terms of the photoreceptor and the image quality.

G2: no problem in terms of the image quality

G3: slight problem in terms of the image quality but by a tolerable value or less G4: drastic defect in terms of the image quality (black stripes, dropping) and by worse than the tolerable value —Image Quality Maintenance Evaluation—

For the image quality maintenance, three aspects of fogging, defects such as the black stripes and the dropping, and the density reproduction maintenance are evaluated.

(Fogging)

Fogging of the photoreceptor (latent image bearing body) surface after printing 10,000 sheets, and the printed matter surface after formation of the image after printing 10,000 sheets are observed visually. The evaluation criteria are as follows.

G1: no fogging on the photoreceptor

G2: slight fogging on the photoreceptor

G3: fogging observed on the photoreceptor but no fogging on the printed matter

G4: fogging observed also on the printed matter (Defects Such as the Black Stripes and the Dropping)

Image defects such as the stripes and the dropping of the photoreceptor (latent image bearing body) surface after printing 10,000 sheets, and the printed matter surface after formation of the image after printing 10,000 sheets are observed visually. The evaluation criteria are as follows.

G1: no generation

G2: slight generation on the photoreceptor but no problem

G3: generation on the photoreceptor but without generation on the copy

G4: generation on the copy (Density Reproduction Maintenance)

For the density reproduction maintenance, the density (Ci) of the printing initial state and the density (Ce) after printing 10,000 sheets are measured with a Macbeth density meter for finding the density ratio (Ce/Ci), and it is evaluated according to the following criteria.

G1: 0.8 or more and 1.2 or less density ratio
G2: 0.65 or more and less than 0.8 density ratio
G3: 0.5 or more and less than 0.65 density ratio
G4: less than 0.5 density ratio
(Document Storage Property)

With a Cin 100% image superimposed on a white paper and a 20 g/cm$^2$ pressure load applied, it is stored for 5 days in a 50° C., 50% RH constant temperature constant humidity vessel for observing the image transfer property after the storage.

G1: no image transfer to the white paper part at all
G2: no transfer even though a slight peeling sound is generated at the time of peel off
G3: slight transfer of the image (10% or less by the area) to the white paper part
G4: considerable transfer (10% or more) to the white paper part
(Image Bending Strength)

With a Cin 100% image disposed inner side, it is folded in two and furthermore, a 10 g/cm$^2$ pressure load is applied for 1 minute. Then, the folded image is opened for wiping the folded portion with gauge lightly so as to evaluate the degree of the lacking of the image visually.

G1: no image defect at all
G2: stripes observed slightly (100 μm or less width)
G3: image lacking observed but by a tolerable range (500 μm or less width)
G4: drastic image defect to the intolerable range (500 or more μm width)

What is claimed is:

1. A toner for developing an electrostatic latent image comprising at least:

a core layer including at least a coloring agent and a first binder resin, the first binder resin comprises: 1,9-nonane diol; bisphenol A-ethylene oxide addition product; dimethyl terephthalate; and dimethyl isophthalate; and a shell layer for covering the core layer and including a second binder resin, the second binder resin comprises: bisphenol A-propylene oxide addition product; trimethylol propane; and terephthalic acid, wherein two local maximum values of tangent loss (tan δ) of dynamic visco-elasticity are present in a temperature range of 90° C. or less, with one of the two local maximum values present in a range of less than 60° C., and an other of the two local maximum values present in a range of 60° C. or more and 90° C. or less.

2. The toner for developing an electrostatic latent image according to claim 1, wherein the difference between the temperature of the one of the two local maximum values and the temperature of the other of the two local maximum values is 5° C. or more.

3. The toner for developing an electrostatic latent image according to claim 1, wherein the glass transition temperature of the first binder resin is in a range of 25° C. or more and less than 50° C., and the glass transition temperature of the second binder resin is in a range of 50° C. or more and 75° C. or less.

4. The toner for developing an electrostatic latent image according to claim 1, wherein a releasing agent is included in the core layer.

5. The toner for developing an electrostatic latent image according to claim 1, wherein magnetic metal particles having a 50 to 250 nm volume average particle size are used as the coloring agent.

6. The toner for developing an electrostatic latent image according to claim 5, wherein the surface of the magnetic metal particles is covered with a covering layer, the covering layer includes at least one element selected from the group consisting of Si, Ti, Ca and P, and at least one kind of polarized group selected from the group consisting of a $SO_3^-$ group and a $COO^-$ group is included in the surface of the covering layer.

7. The toner for developing an electrostatic latent image according to claim 1, wherein the volume average particle size of the toner is in a range of 5 to 9 μm.

8. The toner for developing an electrostatic latent image according to claim 1, wherein the shape factor SF1 of the toner is in a range of 125 to 145.

9. The toner for developing an electrostatic latent image according to claim 1, wherein the absolute value of the difference of the SP value of the first binder resin and the SP value of the second binder resin is in a range of 0.1 to 1.5.

10. The toner for developing an electrostatic latent image according to claim 1, wherein an external additive having an average particle size in a range of 40 to 150 nm is added externally to the toner.

11. The toner for developing an electrostatic latent image according to claim 1, produced by at least:

forming aggregate particles by adding a flocculating agent to a dispersion mixture of at least a first resin particle dispersion with first resin particles having a 1 μm or smaller volume average particle size in which the first binder resin is dispersed and a coloring agent dispersion in which a coloring agent is dispersed, and heating;

forming adhered resin aggregate particles by adding a second resin particle dispersion with second resin particles having a 1 μm or smaller volume average particle size in which the second binder resin is dispersed into the dispersion mixture in which the aggregate particles are formed in order to adhere the second resin particles to the surface of the aggregate particles; and fusing the adhered resin aggregate particles by heating at a temperature equal to or higher than the glass transition temperature of the second binder resin.

12. A developer for developing an electrostatic latent image, including a toner, wherein a toner for developing an electrostatic latent image comprises at least:

a core layer including at least a coloring agent and a first binder resin, the first binder resin comprises: 1,9-nonane diol; bisphenol A-ethylene oxide addition product; dimethyl terephthalate; and dimethyl isophthalate; and a shell layer for covering the core layer and including a second binder resin, the second binder resin comprises: bisphenol A-propylene oxide addition product; trimethylol propane; and terephthalic acid, wherein two local maximum values of tangent loss (tan δ) of dynamic visco-elasticity are present in a temperature range of 90° C. or less, with one of the two local maximum values present in a range of less than 60° C., and an other of the two local maximum values present in a range of 60° C. or more and 90° C. or less is used as the toner.

13. A production method for the toner for developing an electrostatic latent image according to claim 1, comprising:

forming aggregate particles by adding a flocculating agent to a dispersion mixture of at least a first resin particle dispersion with first resin particles having a 1 μm or smaller volume average particle size in which the first binder resin is dispersed and a coloring agent dispersion in which the coloring agent is dispersed, and heating;

forming adhered resin aggregate particles by adding a second resin particle dispersion with second resin particles having a 1 μm or smaller volume average particle size in which the second binder resin is dispersed into the dispersion mixture in which the aggregate particles are formed in order to adhere the second resin particles to the surface of the aggregate particles; and fusing the adhered resin aggregate particles by heating at a temperature equal to or higher than the glass transition temperature of the second binder resin.

14. The production method for a toner for developing an electrostatic latent image according to claim 13, wherein a magnetic metal particle dispersion in which magnetic metal particles having a 50 to 250 nm volume average particle size are dispersed is used as the coloring agent dispersion.

15. The production method for a toner for developing an electrostatic latent image according to claim 13, wherein a releasing agent dispersion in which a releasing agent is dispersed is included in the dispersion mixture to be used when for forming the aggregate particles.

16. The production method for a toner for developing an electrostatic latent image according to claim 13, wherein the absolute value of the difference of the SP value of the first binder resin and the SP value of the second binder resin is in a range of 0.1 to 1.5.

17. An image forming method comprising:

charging a surface of a latent image bearing body;

forming an electrostatic latent image by exposing the charged surface of the latent image bearing body according to image information;

forming a toner image by developing an electrostatic latent image with a developer including a toner;

transferring the toner image onto a recording medium surface; and fixing the toner image transferred onto the recording medium surface by heating and pressurizing, wherein the toner is the toner according to claim 1.

* * * * *